US011486255B2

(12) United States Patent
Sasao et al.

(10) Patent No.: US 11,486,255 B2
(45) Date of Patent: Nov. 1, 2022

(54) STEAM TURBINE BLADE, STEAM TURBINE, AND METHOD FOR MANUFACTURING STEAM TURBINE BLADE

(71) Applicant: Mitsubishi Hitachi Power Systems, Ltd., Yokohama (JP)

(72) Inventors: Yasuhiro Sasao, Yokohama (JP); Soichiro Tabata, Yokohama (JP); Shohei Danno, Yokohama (JP); Yoshinori Tanaka, Yokohama (JP); Hideyuki Toda, Yokohama (JP); Yu Shibata, Yokohama (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 134 days.

(21) Appl. No.: 16/633,348

(22) PCT Filed: Aug. 27, 2018

(86) PCT No.: PCT/JP2018/031532
§ 371 (c)(1),
(2) Date: Jan. 23, 2020

(87) PCT Pub. No.: WO2019/049703
PCT Pub. Date: Mar. 14, 2019

(65) Prior Publication Data

US 2020/0165920 A1 May 28, 2020

(30) Foreign Application Priority Data

Sep. 5, 2017 (JP) ..... JP2017-170123
Sep. 5, 2017 (JP) ..... JP2017-170124

(51) Int. Cl.
*F01D 5/18* (2006.01)

(52) U.S. Cl.
CPC ..... *F01D 5/18* (2013.01); *F05D 2220/31* (2013.01); *F05D 2230/50* (2013.01); *F05D 2240/30* (2013.01)

(58) Field of Classification Search
CPC combination set(s) only.
See application file for complete search history.

(56) References Cited

U.S. PATENT DOCUMENTS 2,362,831 A * 11/1944 Kraft ..... F01D 5/18 415/115
4,738,585 A 4/1988 von Bockh
(Continued)

FOREIGN PATENT DOCUMENTS

GB 316381 A 8/1929
JP 64-045904 A 2/1989
(Continued)

OTHER PUBLICATIONS

International Search Report dated Sep. 18, 2018, issued in counterpart Application No. PCT/JP2018/031532, with English Translation. (4 pages).
(Continued)

*Primary Examiner* — Aaron R Eastman
(74) *Attorney, Agent, or Firm* — WHDA, LLP

(57) ABSTRACT

A steam turbine blade includes a blade body (7) including blade surfaces (70) extending in a blade height direction. The blade body (7) includes a first suction port (74) extending in the blade height direction and opening in the blade surface (70), a first drain flow path (75) internally extending in the blade height direction, and first communication passages (76) internally provided away from one another in the blade height direction and independently of one another and making the first drain port (74) and the first drain flow path (75) in communication with each other.

18 Claims, 10 Drawing Sheets

(56) References Cited

U.S. PATENT DOCUMENTS

| | | | | |
|---|---|---|---|---|
| 6,305,902 | B1 | 10/2001 | Konishi et al. | |
| 2010/0329853 | A1* | 12/2010 | Guo | F01D 25/32 415/169.2 |
| 2013/0149106 | A1* | 6/2013 | Giusti | F01D 25/32 415/115 |
| 2013/0177397 | A1* | 7/2013 | Burdgick | F01D 25/32 415/115 |
| 2014/0030065 | A1* | 1/2014 | Nakano | F01D 25/32 415/115 |
| 2014/0079556 | A1* | 3/2014 | Ishibashi | F01D 5/145 416/223 A |
| 2014/0154066 | A1* | 6/2014 | Mukhopadhyay | F01D 9/02 415/191 |
| 2021/0010379 | A1* | 1/2021 | Taniguchi | F01D 5/08 |

FOREIGN PATENT DOCUMENTS

| | | | |
|---|---|---|---|
| JP | H11-210404 | A | 8/1999 |
| JP | H11-336503 | A | 12/1999 |
| JP | 2013-139807 | A | 7/2013 |
| JP | 2014-025443 | A | 2/2014 |
| JP | 5919123 | B2 | 5/2016 |

OTHER PUBLICATIONS

Written Opinion dated Sep. 18, 2018, issued in counterpart Application No. PCT/JP2018/031532, with English Translation. (23 pages).

* cited by examiner

STEAM TURBINE BLADE, STEAM TURBINE, AND METHOD FOR MANUFACTURING STEAM TURBINE BLADE

TECHNICAL FIELD

The present invention relates to a steam turbine blade, a steam turbine, and a method for manufacturing a steam turbine blade.

This application claims priority based on JP 2017-170124 and JP 2017-170123 filed in Japan on Sep. 5, 2017, of which the contents are incorporated herein.

BACKGROUND ART

A steam turbine is used for mechanical driving or the like, and includes a rotatably supported rotor and a casing covering the rotor. The steam turbine is rotationally driven by supplying steam to the rotor as a working fluid. In the steam turbine, the rotor is provided with a rotor blade, and the casing covering the rotor is provided with a stator blade. A plurality of rotor blades and stator blades are alternately disposed in multiple stages in a steam flow path of the steam turbine. When steam flows through the steam flow path, the stator blades regulate the flow of steam, and the rotor is rotationally driven by the flow of steam via the rotor blades.

In the steam turbine, pressure significantly decreases consistently with a distance to a final stage of the steam turbine. Thus, the flowing steam eventually reaches a saturation vapor pressure, at which the steam is in a wet steam state in which the steam contains liquefied fine water droplets (water droplet cores). Many of the fine water droplets (drain) pass between the blade rows along with the steam, but some water droplets adhere to blade surfaces due to inertia, thus forming liquid films on the blade surfaces. After the liquid films have migrated to trailing edges of the blades, the liquid films again scatter in the steam flow and become coarse water droplets. As is known, the coarse water droplets collide with the rotor blades at a high relative speed, generating erosion on the rotor blade surfaces.

In contrast, for reduction in the effect of the drain, removing the drain itself adhering to the blade surfaces is most effective. Patent Document 1 describes a structure for collecting droplets adhering to blade surfaces, the structure being provided at a trailing end of a hollow-wing-shaped stator blade formed by plastically processing a metal plate on a blade suction-side and a metal plate on a blade pressure-side. Specifically, the stator blade described in Patent Document 1 is formed with a slit extending in a blade height direction, and a plurality of second slits formed in a blade height direction and upstream from the above-described slit in a main flow direction. The slit and the second slits are in communication with a hollow portion inside a blade body. Drain adhering to the blade surface is collected in the blade body via the slit and the second slits.

Patent Document 2 describes a stator blade formed with a pressure-side slit in a pressure-side blade surface and a suction-side slit in a suction-side blade surface. Two independent hollow cavities are formed inside the stator blade so as to penetrate the stator blade from an inner shroud to an outer shroud. The pressure-side slit and the suction-side slit are each in communication with different hollow cavities. This inhibits the collected drain from flowing out again, improving efficiency of collection of the drain.

In the stator blade described in Patent Document 2, two independent hollow cavities need to be formed inside. In a case where the stator blade itself is formed by casting, the hollow cavities are formed simultaneously with the blade surface using a core or the like, or are formed during post-processing using a drill or the like. Also in a case where the stator blade is formed by cutting a plate member, the hollow cavities are also formed during post-processing using a drill or the like.

CITATION LIST

Patent Document

Patent Document 1: JP 5919121 B
Patent Document 2: JP H11-336503 A

SUMMARY OF INVENTION

Technical Problem

In the stator blade described in Patent Document 1, the plurality of slits and the plurality of second slits are connected to the hollow portion inside the blade body through one communication passage. In other words, the slits are internally linked together via the communication passage. As a result, due to a pressure difference occurring around the blade surface in the blade height direction, drain sucked from the slit disposed in a high pressure portion may migrate in the blade height direction within the communication passage, and flow out again from another slits disposed in a low pressure portion. Thus, efficiently removing the drain adhering to the blade surface is difficult.

An object of the present invention is to provide a steam turbine blade, a steam turbine, and a method for manufacturing a steam turbine blade capable of efficiently removing drain adhering to a blade surface.

Solution to Problem

A steam turbine blade according to a first aspect of the present invention includes a blade body including blade surfaces extending in a blade height direction, and the blade body includes a first suction port extending in the blade height direction and opening in the blade surface, a first drain flow path internally extending in the blade height direction, and a plurality of first communication passages internally provided away from one another in the blade height direction and independently of one another and making the first suction port and the first drain flow path in communication with each other.

According to such a configuration, even in a case where a pressure difference occurs around the blade surface in the blade height direction in which the first suction port extends, drain in the first communication passages is inhibited from migrating in the blade height direction in accordance with the pressure difference. As a result, the drain drawn once into the first communication passage from the first suction port located in a high pressure portion is inhibited from flowing to the outside again from the first suction port located in a low pressure portion. Accordingly, the drain collected once from the first suction port can be inhibited from flowing to the outside.

Additionally, in the steam turbine blade according to a second aspect of the present invention, in the first aspect, the first suction port may be formed in a recessed surface-shaped pressure-side surface of the blade surface.

According to such a configuration, the drain adhering to the pressure-side surface can be collected.

Additionally, in the steam turbine blade according to a third aspect of the present invention, in the first aspect, the first suction port may be formed at a trailing edge-side end portion of the blade surface where the recessed surface-shaped pressure-side surface and a protruding surface-shaped suction-side surface are connected.

According to such a configuration, the drain adhering to the suction-side surface or the pressure-side surface and flowing to the trailing edge side can be collected at a furthest downstream end portion. As a result, more drain can be collected from the first suction port. Accordingly, the drain adhering to the blade surface can be efficiently collected.

Additionally, in the steam turbine blade according to a fourth aspect of the present invention, in any one of the first to third aspects, the first suction port may be formed in an upper half region of the blade surface in the blade height direction.

According to such a configuration, the drain adhering to the upper half region of the blade surface in the blade height direction can be allowed to flow into the first suction port. Thus, the drain adhering to the upper half region of the blade surface and flowing toward the trailing edge-side can be accurately collected.

Additionally, in the steam turbine blade according to a fifth aspect of the present invention, in any one of the first to fourth aspects, the blade body may include a second drain flow path internally extending in the blade height direction and formed closer to a leading edge of the blade body with respect to the first drain flow path, a second suction port opening in the protruding surface-shaped suction-side surface, a second communication passage making the second suction port and the second drain flow path in communication with each other, and a partition portion partitioning off the second drain flow path and the first drain flow path independently of each other inside the blade body.

According to such a configuration, the partition portion makes the first drain flow path and the second drain flow path independent of each other, allowing the first suction port and the second suction port to be prevented from communicating with each other inside the blade body. Thus, drain collected via the first suction port can be prevented from flowing, through the inside of the blade body, out from the second suction port formed in the suction-side surface that is in low pressure.

Additionally, in the steam turbine blade according to a sixth aspect of the present invention, in the fifth aspect, the blade body may include a suction-side plate member forming a protruding surface-shaped suction-side surface as the blade surface, a pressure-side plate member forming a recessed surface-shaped pressure-side surface as the blade surface, and a plurality of joining portions joining the suction-side plate member and the pressure-side plate member, and one of the plurality of joining portions may form the partition portion.

According to such a configuration, even in a case where the blade body has a shape difficult to process, by pre-processing and joining two plate members such that the plate members form a partition portion, two spaces extending in the blade height direction inside the blade body can be easily formed independently of each other. Thus, the first drain flow path and the second drain flow path can be formed with inhibiting the effect of processing difficulty due to the shape of the blade body.

Additionally, in the steam turbine blade according to a seventh aspect of the present invention, in the sixth aspect, the first drain flow path may be formed between the suction-side plate member and the pressure-side plate member by a first drain flow path forming surface formed on each of a suction-side plate member inner surface located on a side of the pressure-side plate member than the suction-side surface in the suction-side plate member and a pressure-side plate member inner surface located on a side of the suction-side plate member than the pressure-side surface in the pressure-side plate member, and the first drain flow path forming surface may be formed recessed from at least one of the suction-side plate member inner surface and the pressure-side plate member inner surface.

According to such a configuration, by forming the first drain flow path forming surface such that the first drain flow path forming surface is recessed from at least one of the suction-side plate member and the pressure-side plate member, a larger first drain flow path can be formed without any increase in plate thicknesses of the suction-side plate member and the pressure-side plate member.

Additionally, in the steam turbine blade according to an eighth aspect of the present invention, in the sixth or seventh aspect, each of the plurality of the first communication passage may be formed between the suction-side plate member and the pressure-side plate member by a fast communication passage forming surface formed on each of a suction-side plate member inner surface located on a side of the pressure-side, plate member than the suction-side surface in the suction-side plate member and a pressure-side plate member inner surface located on a side of the suction-side plate member than the pressure-side surface in the pressure-side plate member, and the first communication passage forming surface may be formed recessed from at least one of the suction-side plate member inner surface and the pressure-side plate member inner surface.

According to such a configuration, the first communication passage forming surface can be formed simply by processing a surface of the plate-shaped suction-side plate member or pressure-side plate member. Thus, processing of the first communication passage forming surface is facilitated. Additionally, the first communication passages are formed between the suction-side plate member and the pressure-side plate member by the first communication passage forming surface. Thus, the first communication passages can be easily formed inside the blade body.

Additionally, in the steam turbine blade according to a ninth aspect of the present invention, in any one of the sixth to eighth aspects, the first suction port may be formed, in the suction-side plate member, by a first suction port suction-side forming surface recessed from a suction-side plate member inner surface located on a side of the pressure-side plate member than the suction-side surface and a trailing edge-side end surface of the pressure-side plate member.

Additionally, a steam turbine according to a tenth aspect of the present invention includes a rotor shaft configured to rotate around an axial line, and the steam turbine blade according to any one of the first to ninth aspects disposed surrounding the rotor shaft.

According to such a configuration, the steam turbine blade can be used to efficiently collect drain, allowing the steam turbine to be efficiently operated.

Additionally, a method for manufacturing a steam turbine blade according to an eleventh aspect of the present invention is a method of manufacturing a steam turbine blade including a first suction port extending in a blade height direction and opening in a blade surface of a blade body, the blade body includes the blade surface extending in the blade height direction, a first drain flow path extending in the blade height direction inside the blade body, and a plurality of first communication passages provided away from one another in the blade height direction inside the blade body and independently of one another and making the first suction port and the first drain flow path in communication with each other, the method including preparing a plate-shaped suction-side plate member capable of being formed into a protruding surface-shaped suction-side surface as the blade surface and a plate-shaped pressure-side plate member capable of being formed into a recessed surface-shaped pressure-side surface as the blade surface, processing the suction-side plate member and the pressure-side plate member, and joining the suction-side plate member and the pressure-side plate member to form the first drain flow path and the plurality of first communication passages between the suction-side plate member and the pressure-side plate member, wherein in the processing, a first suction port forming surface forming the first suction port is formed on at least one of the suction-side plate member and the pressure-side plate member, a first drain flow path forming surface forming the first drain flow path, and a first communication passage forming surface forming the first communication passage is formed on both the suction-side plate member and the pressure-side plate member, the suction-side surface is formed on the suction-side plate member, and the pressure-side surface is formed on the pressure-side plate member.

According to such a configuration, by pre-processing the plate-shaped suction-side plate member and pressure-side plate member, the processing can be achieved without being affected by the final shape of the blade body. Thus, the first suction port forming surface, the first drain flow path forming surface, and the first communication passage forming surface can be formed simply by processing a plate-shaped suction-side plate member and pressure-side plate member. As a result, processing of the first suction port forming surface, the first drain flow path forming surface, and the first communication passage forming surface is facilitated. Additionally, the first suction port forming surface, the first drain flow path forming surface, and the flow communication passage forming surface form the first suction port, the first drain flow path, and the first communication passages. Thus, even in a case where the blade body is thin or has a shape difficult to process as in a case where the blade surface is formed by a complex three-dimensional curved surface, the first suction port, the first drain flow path, and the first communication passages can be easily formed inside the blade body with inhibiting the effect of processing difficulty due to the final shape of the blade body.

Additionally, in the method for manufacturing a steam turbine blade according to a twelfth aspect of the present invention, in the eleventh aspect, the processing may include removing by cutting a part of the suction-side plate member and the pressure-side plate member, and bending the suction-side plate member and the pressure-side plate member, in the removing, the first suction port forming surface, the first drain flow path forming surface, and the first communication passage forming surface may be formed, and in the bending, the suction-side surface and the pressure-side surface may be formed.

According to such a configuration, formation of the first suction port, the first drain flow path, and the first communication passage does not require new preparation of members other than the suction-side plate member and the pressure-side plate member. As a result, the number of components forming the blade body can be reduced, enabling a reduction in the manufacturing costs of the blade body.

Additionally, in the method for manufacturing a steam turbine blade according to a thirteenth aspect of the present invention, in the twelfth aspect, in the removing, when the suction-side plate member and the pressure-side plate member are joined, the first drain flow path forming surface may be formed recessed from at least one of the suction-side plate member inner surface located on a side of the pressure-side plate member than the suction-side surface in the suction-side plate member and the pressure-side plate member inner surface located on a side of the suction-side plate member than the pressure-side surface in the pressure-side plate member.

According to such a configuration, by forming the first drain flow path forming surface such that the first drain flow path forming surface is recessed from at least one of the suction-side plate member and the pressure-side plate member, a larger first drain flow path can be formed without any increase in plate thicknesses of the suction-side plate member and the pressure-side plate member.

Additionally, in the method for manufacturing a steam turbine blade according to a fourteenth aspect of the present invention, in the twelfth or thirteenth aspect, in the removing, when the suction-side plate member and the pressure-side plate member are joined, the first communication passage forming surface may be formed recessed from at least one of the suction-side plate member inner surface located on a side of the pressure-side plate member than the suction-side surface in the suction-side plate member and the pressure-side plate member inner surface located on a side of the suction-side plate member than the pressure-side surface in the pressure-side surface when the suction-side plate member and the pressure-side plate member are joined.

According to such a configuration, the first communication passage forming surface can be formed simply by processing a surface of the plate-shaped suction-side plate member or pressure-side plate member. Thus, processing of the first communication passage forming surface is facilitated. Additionally, first communication passages are formed between the suction-side plate member and the pressure-side plate member by the first communication passage forming surface. Thus, the first communication passages can be easily formed within the blade body.

Additionally, in the method for manufacturing a steam turbine blade according to a fifteenth aspect of the present invention, in any one of the twelfth to fourteenth aspects, in the removing, as the first suction port forming surface, when the suction-side plate member is joined to the pressure-side plate member, a first suction port suction-side forming surface may be formed, which is recessed from the suction-side plate member inner surface located on a side of the pressure-side plate member than the suction-side surface, and in the joining, the suction-side plate member and the pressure-side plate member may be joined to form the first suction port between the first suction port suction-side forming surface and a trailing edge-side end surface of the pressure-side plate member.

Additionally, in the method for manufacturing a steam turbine blade according to a sixteenth aspect of the present invention, in any one of the twelfth to fifteenth aspects, in the preparing, the suction-side plate member and the pressure-side plate member are prepared in a single blade forming plate member, and in the bending, the blade forming plate member is bent to form the suction-side surface and the pressure-side surface and to form a leading edge of the blade body.

According to such a configuration, the blade body can be formed with a reduced number of components. As a result, the manufacturing costs of the blade body can be reduced.

Additionally, in the method for manufacturing a steam turbine blade according to a seventeenth aspect of the present invention, in any one of the twelfth to sixteenth aspects, in the bending, a second drain flow path forming surface forming a second drain flow path extending in the blade height direction inside the blade body and formed closer to the leading edge of the blade body than the first drain flow path may be formed by bending with the suction-side surface and the pressure-side surface, and in the removing, a second communication passage may be formed that penetrates the suction-side plate member to make the suction-side surface and the second drain flow path forming surface of the suction-side plate member in communication with each other.

According to such a configuration, the second drain flow path forming surface can be formed simply by bending the plate-shaped suction-side plate member and pressure-side plate member. As a result, processing of the second drain flow path forming surface is facilitated. Additionally, the second drain flow path is formed by the second drain flow path forming surface. Thus, even in a case where the blade body is thin or has a final shape difficult to process internally as in a case where the blade surface is formed by a complex three-dimensional curved surface, the second drain flow path can be easily formed inside the blade body.

Additionally, in the method for manufacturing a steam turbine blade according to an eighteenth aspect of the present invention, in the seventeenth aspect, in the joining, the suction-side plate member and the pressure-side plate member may be joined between the second drain flow path forming surface and the first drain flow path forming surface to form a partition portion partitioning off the second drain flow path and the first drain flow path independently of each other.

According to such a configuration, even in a case where the blade body has a shape difficult to process, by pre-processing and joining the two plate members to form the partition portion, two spaces extending in the blade height direction inside the blade body can be easily formed independently of each other. Thus, the first drain flow path and the second drain flow path can be formed with inhibiting the effect of processing difficulty due to the shape of the blade body.

Additionally, a steam turbine blade of a nineteenth aspect of the present invention includes a blade body including blade surfaces extending in a blade height direction, and the blade body includes a suction-side plate member forming a protruding surface-shaped suction-side surface as the blade surface, a pressure-side surface plate member forming a recessed surface-shaped pressure-side surface as the blade surface, a plurality of joining portions joining the suction-side plate member and the pressure-side plate member, a first drain flow path extending in the blade height direction between the suction-side plate member and the pressure-side plate member, a second drain flow path extending in the blade height direction between the suction-side plate member and the pressure-side plate member and formed closer to the leading edge of the blade body than the first drain flow path, a first suction port and a second suction port opening in the blade surface, a first communication passage making the first suction port and the first drain flow path in communication with each other, a second communication passage making the second suction port and the second drain flow path in communication with each other, and a partition portion partitioning off the second drain flow path and the first drain flow path independently of each other inside the blade body. One of the plurality of joining portions forms the partition portion.

According to such a configuration, the partition portion makes the first drain flow path and the second drain flow path independent of each other, allowing the first suction port and the second suction port to be prevented from communicating with each other inside the blade body. Thus, drain collected via the first suction port can be prevented from flowing, through the inside of the blade body, out from the second suction port formed in the suction-side surface which is in low pressure. Additionally, even in a case where the blade body has a shape difficult to process, by pre-processing and joining the two plate members to form the partition portion, two spaces extending in the blade height direction inside the blade body can be easily formed independently of each other. Thus, the first drain flow path and the second drain flow path can be formed with inhibiting the effect of processing difficulty due to the final shape of the blade body.

Additionally, a method for manufacturing a steam turbine blade according to a twentieth aspect of the present invention is a method for manufacturing a steam turbine blade including a first drain flow path extending in a blade height direction inside a blade body including blade surfaces extending in the blade height direction, a second drain flow path located closer to a leading edge of the blade body than the first drain flow path inside the blade body and extending in the blade height direction, a first suction port and a second suction port opening in the blade surface, a first communication passage making the first suction port and the first drain flow path in communication with each other, and a second communication passage making the second suction port and the second drain flow path in communication with each other, the method including preparing a suction-side plate member capable of being formed into a protruding surface-shaped suction-side surface as the blade surface and a pressure-side plate member capable of being formed into a recessed surface-shaped pressure-side surface as the blade surface, processing the suction-side plate member and the pressure-side plate member, and joining the suction-side plate member and the pressure-side plate member to form the first drain flow path and the second drain flow path between the suction-side plate member and the pressure-side plate member, wherein the joining includes removing by cutting a part of the suction-side plate member and the pressure-side plate member; and bending the suction-side plate member and the pressure-side plate member, in the removing, a first drain flow path forming surface forming the first drain flow path and a second drain flow path forming surface forming the second drain flow path are formed on both the suction-side plate member and the pressure-side plate member, in the bending, the suction-side surface is formed in the suction-side plate member, and the pressure-side surface is formed in the pressure-side plate member, and in the joining, the suction-side plate member and the pressure-side plate member are joined between the second drain flow path forming surface and the first drain flow path forming surface to form a partition portion partitioning off the second drain flow path and the first drain flow path independently of each other.

According to such a configuration, by pre-processing the plate-shaped suction-side plate member and pressure-side plate member, the processing can be achieved without being affected by the final shape of the blade body. Thus, the first drain flow path forming surface and the second drain flow path forming surface can be formed simply by processing the plate-shaped suction-side plate member and pressure-side plate member. As a result, processing of the first drain flow path forming surface and the second drain flow path forming surface is facilitated. Additionally, the first drain flow path and the second drain flow path are formed by the first drain flow path forming surface and the second drain flow forming surface. Thus, even in a case where the blade body is thin or has a final shape difficult to process internally as in a case where the blade surface is formed by a complex three-dimensional curved surface, the first drain flow path and the second drain flow path can be easily formed inside the blade body. Furthermore, formation of the first drain flow path does not require new preparation of members other than the suction-side plate member and the pressure-side plate member. As a result, the number of components forming the blade body can be reduced, enabling a reduction in the manufacturing cost of the blade body.

Advantageous Effect of Invention

According to the present invention, drain adhering to the blade surface can be efficiently removed.

DESCRIPTION OF EMBODIMENTS

First Embodiment

Embodiments of the present invention will be described below with reference to the accompanying drawings.

Figure 1:
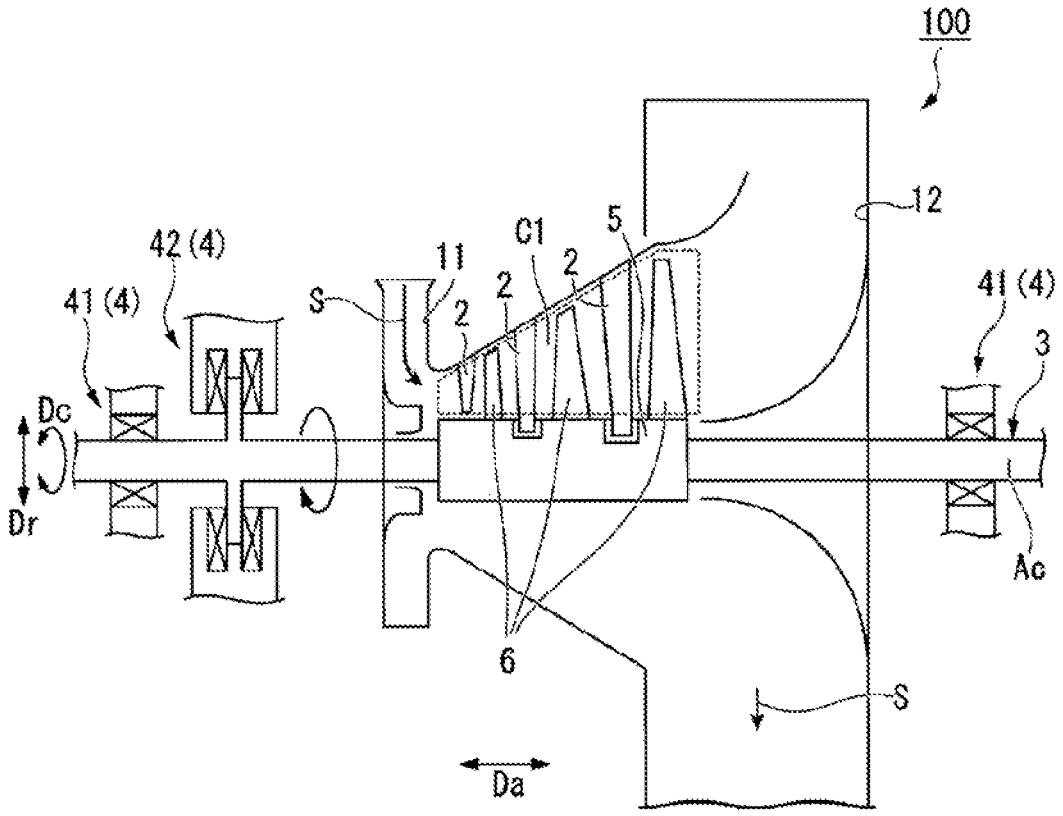
FIG. 1 is a schematic view illustrating a configuration of a steam turbine according to an embodiment of the present invention.

The steam turbine 100 is a rotary machine extracting energy of steam S as rotational power. The steam turbine 100 according to the present embodiment is a low-pressure turbine. As illustrated in FIG. 1, the steam turbine 100 includes a casing 1, a stator blade 2, a rotor 3, and a bearing portion 4.

Note that, hereinafter, a direction in which an axial line Ac extends is referred to as an axial direction Da. Additionally, a circumferential direction relative to the axial line Ac is simply referred to as a circumferential direction Dc. Additionally, a radial direction relative to the axial line Ac is simply referred to as a radial direction Dr. Additionally, one side (first side) in the axial direction Da is referred to as an upstream side, and the other side (second side) in the axial direction Da is referred to as a downstream side.

The internal space of the casing 1 is hermetically sealed, and a flow path of the steam S is formed inside the casing 1. The casing 1 covers the rotor 3 from outside in the radial direction Dr. The casing 1 includes a steam inlet 11 formed in an upstream portion of the casing 1 to guide the steam S into the casing 1. The casing 1 includes a steam outlet 12 formed in a downstream portion of the casing 1 to discharge the steam S, which have passed through the inside of the casing 1, to the outside.

A plurality of stator blades 2 are provided on a surface of the rotor 3 facing the inside of the easing 1 and arranged in juxtaposition along the circumferential direction Dc of the rotor 3. The stator blades 2 are disposed at intervals in the radial direction Dr with respect to the rotor 3. The stator blades 2 are disposed at intervals from rotor blades 6 described below, in the axial direction Da.

The rotor 3 rotates around the axial line Ac. The rotor 3 includes a rotor shaft 5 and the rotor blades 6.

The rotor shaft 5 can rotate around the axial line Ac. The rotor shaft 5 extends in the axial direction Da to penetrate the casing 1. An intermediate portion of the rotor shaft 5 provided with the rotor blades 6 is accommodated inside the casing 1. Both end portions of the rotor shaft 5 protrude to the outside of the casing 1. Both end portions of the rotor shaft 5 are rotatably supported by the bearing portion 4.

The bearing portion 4 rotatably supports the rotor 3 around an axial line Ac. The bearing portion 4 includes journal bearings 41 provided on the respective end portions of the rotor shaft 5, and a thrust bearing 42 provided on first end portion side of the rotor shaft 5.

A plurality of the rotor blades 6 are disposed in juxtaposition in the circumferential direction Dc to surround the rotor shaft 5. The plurality of rotor blades 6 are disposed in an annular shape on an outer circumferential surface of the rotor shaft 5. The rotor blades 6 receive the steam S flowing in the axial direction Da of the rotor 3 to rotate the rotor shaft 5 around the axial line Ac.

Now, the stator blade 2 will be described as an example of the steam turbine blade according to the present embodiment. Note that the steam turbine blade is not limited to the configuration in which the steam turbine blade is the stator blade 2, but may be the rotor blade 6.

Figure 2:
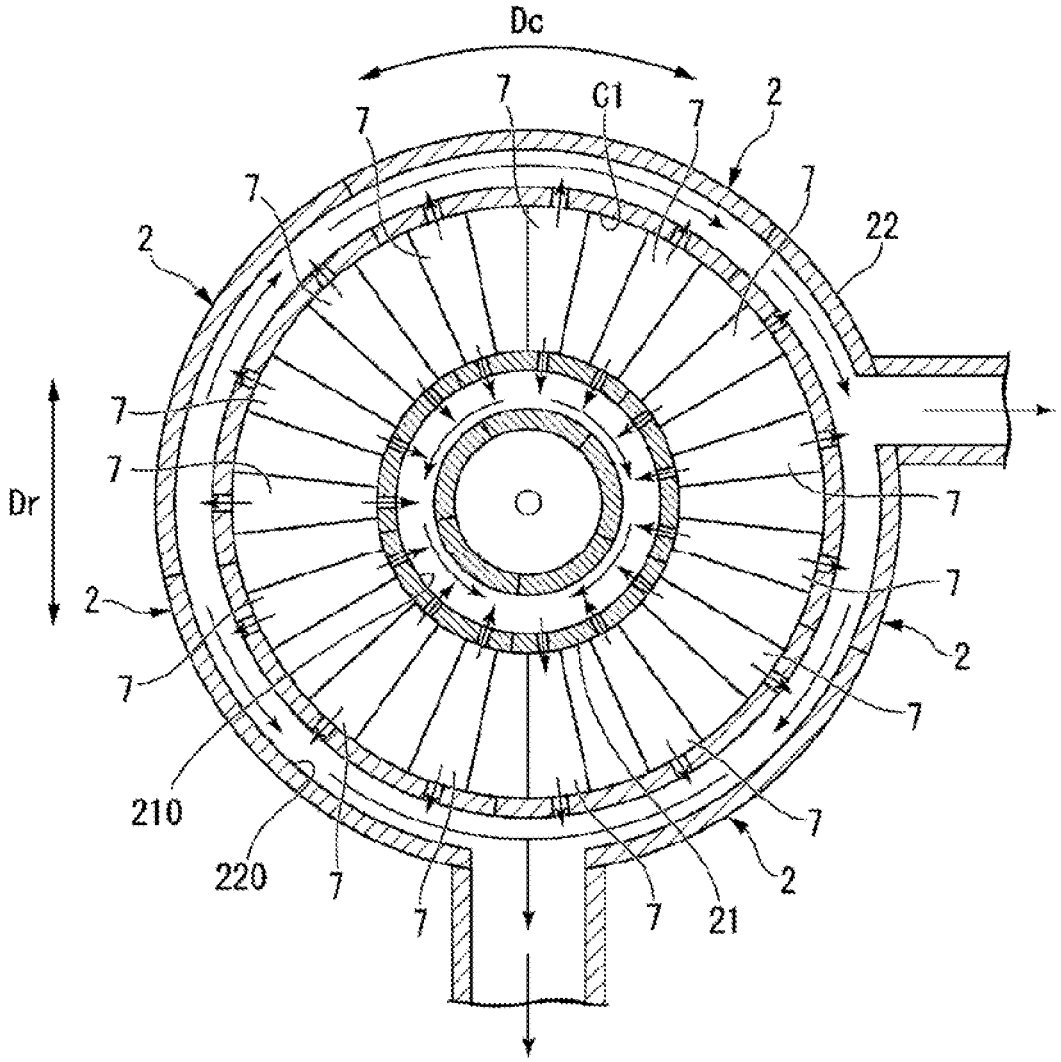
FIG. 2 is a vertical cross-sectional view of a steam turbine according to an embodiment of the present invention illustrating a flow state of drain in the steam turbine.
Figure 3:
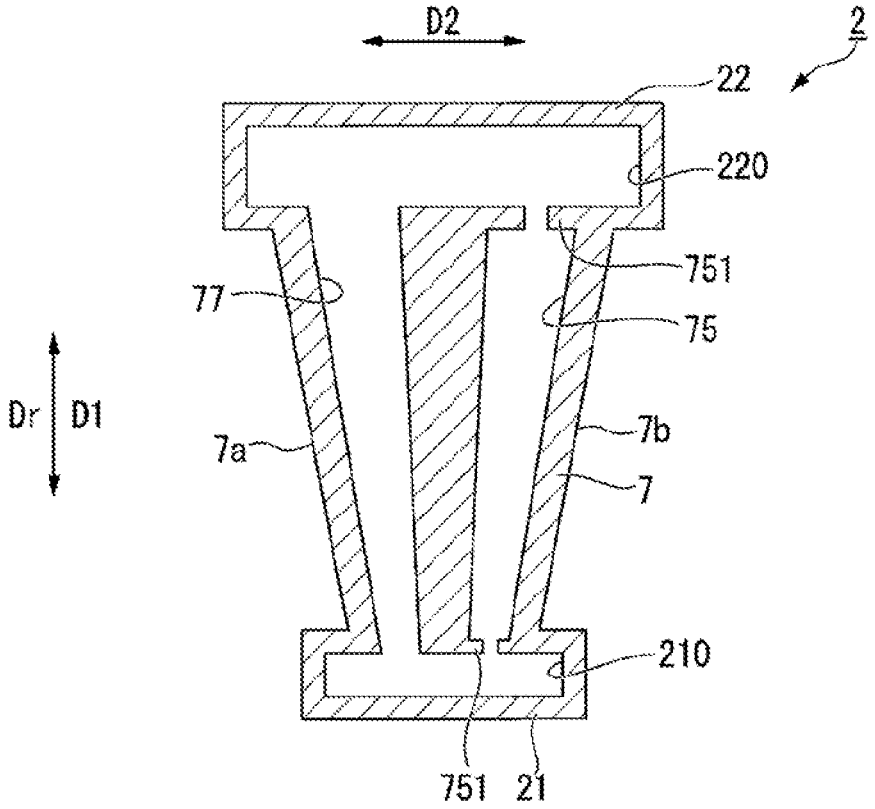
FIG. 3 is a cross-sectional view of a stator blade in a virtual plane spreading in a blade height direction according to the first embodiment of the present invention.

As illustrated in FIG. 2, the stator blades 2 are annularly arranged in juxtaposition and coupled together to form a single stator blade ring. A plurality of the stator blades 2 are disposed in the circumferential direction Dc to surround the rotor shaft 5. As illustrated in FIGS. 2 and 3, the stator blade 2 according to the present embodiment includes a blade body 7, an inner shroud 21, and an outer shroud 22.

Figure 4:
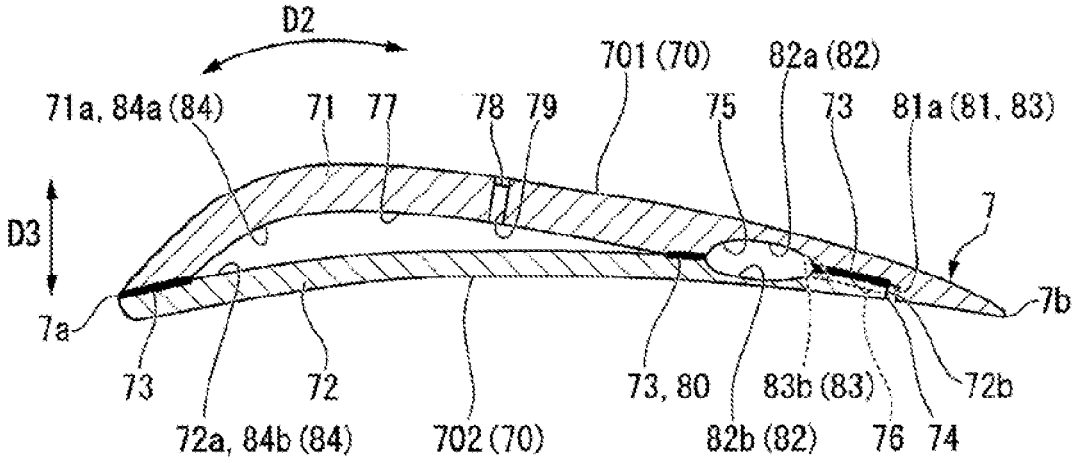
FIG. 4 is a cross-sectional view of a blade body of the stator blade in a virtual plane orthogonal to the blade height direction according to the first embodiment of the present invention.

As illustrated in FIGS. 3 and 4, the blade body 7 has a blade-shaped cross section and extends in a blade height direction D1 corresponding to the radial direction Dr. The blade body 7 includes blade surfaces 70 extending in the blade height direction D1. A suction-side surface 701 of the blade body 7 corresponding to a suction-side blade surface 70 is formed to have a protruding surface shape when the blade body 7 is viewed from the blade height direction D1. A pressure-side surface 702 of the blade body 7 corresponding to a pressure-side blade surface 70 is formed to have a recessed surface shape when the blade body 7 is viewed from the blade height direction D1. A front end portion of the blade body 7 in a chord direction D2 at which the suction-side surface 701 and the pressure-side surface 702 are connected forms a leading edge 7*a*. A rear end portion of the blade body 7 in a chord direction D2 at which the suction-side surface 701 and the pressure-side surface 702 are connected forms a trailing edge 7*b*. A plurality of the blade bodies 7 are arranged in juxtaposition and away from one another in a blade thickness direction D3 corresponding to the circumferential direction Dc.

Here, the blade height direction D1 of the blade body 7 is the direction in which the blade body 7 extends. Additionally, the chord direction D2 of the blade body 7 is a direction orthogonal to the blade height direction D1 according to the present embodiment, and is a direction that is parallel to a virtual line joining an end portion on the leading edge 7*a* side and an end portion on the trailing edge 7*b* side and that includes the direction in which the chord of the blade body 7 extends. The blade thickness direction D3 of the blade body 7 is the direction orthogonal to the blade height direction D1 and the chord direction D2 according to the present embodiment.

As illustrated in FIGS. 2 and 3, the inner shroud 21 couples a plurality of blade bodies 7 together on a base end portion side in the blade height direction D1. The inner shroud 21 according to the present embodiment has a circular arc shape when viewed from the axial direction Da. The inner shroud 21 is internally provided with an inner discharge flow path 210 through which drain described below is discharged. The inner discharge flow path 210 is connected to a condenser not illustrated to have negative pressure (for example, a vacuum).

The outer shrouds 22 couple the plurality of blade bodies 7 on a leading end portion side in the blade height direction D1. Accordingly, the outer shroud 22 is disposed opposite to the inner shroud 21 across the blade body 7 in the blade height direction D1. The outer shroud 22 according to the present embodiment has a circular arc shape when viewed from the axial direction Da. The outer shroud 22 is internally provided with an outer discharge flow path 220 through which the drain described below is discharged. The outer discharge flow path 220 is connected to a condenser not illustrated to have negative pressure (e.g., a vacuum).

As illustrated in FIG. 2, in the stator blade 2, a primary flow path C1 through which steam S flows is formed by the adjacent blade bodies 7, the inner shroud 21, and the outer shroud 22. As illustrated in FIG. 1, the primary flow path C1 is a space inside the casing 1 interposed between the steam suction port 11 and the steam outlet 12. The blade body 7 is disposed in the primary flow path C1 through which the steam S flows. A surface of the inner shroud 21 facing outward in the radial direction Dr defines an inner position of the annular primary flow path C1 in the radial direction Dr. A surface of the outer shroud 22 facing inward in the radial direction Dr defines an outer position of the annular primary flow path C1 in the radial direction Dr.

Additionally, as illustrated in FIG. 4, the blade body 7 according to the present embodiment includes the suction-side plate member 71, the pressure-side plate member 72, and a plurality of joining portions 73.

The suction-side plate member 71 forms a protruding surface-shaped suction-side surface 701 as the blade surface 70. The suction-side plate member 71 is a planar member, and is curved to form a space inside the blade body 7. The suction-side surface 701 is a surface facing outward when the suction-side plate member 71 is joined to the pressure-side plate member 72. Additionally, in the suction-side plate member 71, a suction-side plate member inner surface 71*a* is a surface forming a space inside the blade body 7 when the suction-side plate member 71 is joined to the pressure-side plate member 72, the surface being located on a side of the pressure-side plate member 72 than the suction-side surface 701. The suction-side plate member inner surface 71*a* forms a part of the pressure-side surface 702 at the trailing edge 7*b*, and the suction-side plate member 71 according to the present embodiment forms an end portion of the trailing edge 7*b*.

The pressure-side plate member 72 forms a recessed surface-shaped pressure-side surface 702 as the blade surface 70. The pressure-side plate member 72 is a planar member, and is curved to form a space inside the blade body 7 together with the suction-side plate member 71. The pressure-side surface 702 is a surface facing outward when the pressure-side plate member 72 is joined to the suction-side plate member 71. Additionally, in the pressure-side plate member 72, a pressure-side plate member inner surface 72*a* is a surface forming a space inside the blade body 7 when the pressure-side plate member 72 is joined to the suction-side plate member 71, the surface being located on a side of the suction-side plate member 71 than the pressure-side surface 702.

The joining portions 73 join the suction-side plate member 71 and the pressure-side plate member 72. The joining portion 73 according to the present embodiment is a portion where the suction-side plate member 71 and the pressure-side plate member 72 are joined by brazing, and is formed by solidifying silver solder. The joining portions 73 join the suction-side plate member 71 and the pressure-side plate member 72 without any gap in the blade height direction D1. In the blade body 7 according to the present embodiment, the joining portions 73 are provided in a plurality of areas located away from one another in the chord direction D2, such as the leading edge 7*a*, the trailing edge 7*b*, and a partition portion 80 described below.

Note that the joining portions 73 are not limited to a structure for joining based on brazing, and it is sufficient that the joining portions 73 join the suction-side plate member 71 and the pressure-side plate member 72. The joining portions 73 may be, for example, joined in a welded state.

Additionally, the blade body 7 according to the present embodiment includes a first suction port 74, a first drain flow path 75, a first communication passage 76, a second drain flow path 77, a second suction port 78, a second communication passage 79, and the partition portion 80.

Figure 5:
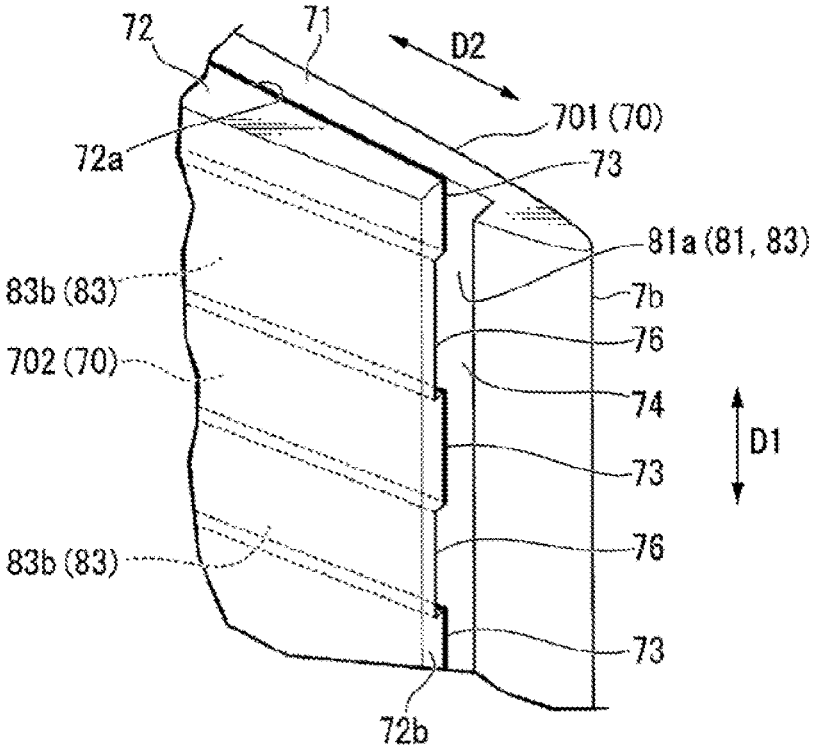
FIG. 5 is a perspective view of main parts illustrating a trailing end portion of the stator blade according to the first embodiment of the present invention.

The first suction port 74 extends in the blade height direction D1 and opens in the blade surface 70. The first suction port 74 according to the present embodiment is formed only in the pressure-side surface 702. The first suction port 74 is formed in an upper half region of the pressure-side surface 702 in the blade height direction D1. Here, the upper half region is a region closer to the outer shroud 22 than a center position in the blade height direction D1. In other words, the first suction port 74 is formed as a single long groove recessed from the center position of the pressure-side surface 702 toward the outer shroud 22 in the blade height direction D1 so as to extend in the blade height direction D1. The first suction port 74 is formed to have an elongate rectangular shape extending in the blade height direction D1 when the pressure-side surface 702 is viewed from the blade thickness direction D3. The first suction port 74 is formed closer to the trailing edge 7*b* with respect to the center in the chord direction D2. The first suction port 74 is formed by a first suction port forming surface 81 formed on at least one of the suction-side plate member 71 and the pressure-side plate member 72. As illustrated in FIG. 5, the first suction port 74 according to the present embodiment is formed by a trailing edge 7*b*-side end surface 72*b* of the pressure-side plate member 72 and the first suction port suction-side forming surface 81*a* recessed from the suction-side plate member inner surface 71*a* of the suction-side plate member 71. Thus, according to the present embodiment, the first suction port forming surface 81 forming the first suction port 74 includes the trailing edge 7*b*-side end surface 72*b* of the pressure-side plate member 72 and the first suction port suction-side forming surface 81*a* formed on the suction-side plate member inner surface 71*a* of the suction-side plate member 71.

As illustrated in FIG. 4, the first drain flow path 75 is a space formed between the suction-side plate member 71 and the pressure-side plate member 72. As illustrated in FIG. 3, the first drain flow path 75 extends in the blade height direction D1 inside the blade body 7. The first drain flow path 75 penetrates the blade body 7 to make the inner shroud 21 and the outer shroud 22 in communication with each other. The first drain flow path 75 is provided with contracting portions 751 narrowing the flow path is formed at connecting portions where the first drain flow path 75 connects to spaces respectively formed in the inner shroud 21 and the outer shroud 22. As illustrated in FIG. 4, the first drain flow path 75 is formed between the suction-side plate member 71 and the pressure-side plate member 72 by a first drain flow path forming surface 82 formed on each of the suction-side plate member inner surface 71*a* and the pressure-side plate member inner surface 72*a*. The first drain flow path forming surface 82 is formed recessed from at least one of the suction-side plate member inner surface 71*a* and the pressure-side plate member inner surface 72*a*. The first drain flow path 75 according to the present embodiment is formed by a first drain flow path suction-side forming surface 82*a* recessed from the suction-side plate member inner surface 71*a* to form a recessed curved surface and a first drain flow path pressure-side surface forming surface 82*b* recessed from the pressure-side plate member inner surface 72*a* to form a recessed curved surface. The first drain flow path suction-side forming surface 82*a* according to the present embodiment is recessed from the first suction port suction-side forming surface 81*a* to form a recessed curved surface. Accordingly, the first drain flow path forming surface 82 forming the first drain flow path 75 according to the present embodiment includes the first drain flow path suction-side forming surface 82*a* formed on the suction-side plate member inner surface 71*a* and the first drain flow path pressure-side forming surface 82*b* formed on the pressure-side plate member inner surface 72*a*. In other words, the first drain flow path forming surface 82 according to the present embodiment is recessed from both the suction-side plate member inner surface 71*a* and the pressure-side plate member inner surface 72*a*.

As illustrated in FIG. 5, a plurality of first communication passages 76 are formed away from one another in the blade height direction D1 inside the blade body 7. The plurality of first communication passages 76 make the first suction port 74 and the first drain flow path 75 in communication with each other and independent of each other. In other words, the plurality of first communication passage passages 76 are formed so as not to link to one another between the first suction port 74 and the first drain flow path 75. The first communication passages 76 are spaces formed between the suction-side plate member 71 and the pressure-side plate member 72. The first communication passages 76 are formed between the suction-side plate member 71 and the pressure-side plate member 72 by a first communication passage forming surface 83 formed on each of the suction-side plate member inner surface 71*a* and the pressure-side plate member inner surface 72*a*. The first communication passage forming surface 83 is formed recessed from at least one of the suction-side plate member inner surface 71*a* and the pressure-side plate member inner surface 72*a*. The first communication passages 76 according to the present embodiment are formed by the first suction port suction-side forming surface 81*a* and a first communication passage pressure-side forming surface 83*b* recessed from the pressure-side plate member inner surface 72*a* of the pressure-side plate member 72 in an angular groove shape. Thus, the first communication passage forming surface 83 forming the first communication passages 76 according to the present embodiment includes a part of the first suction port suction-side forming surface 81*a* and the first communication passage pressure-side forming surface 83*b* formed on the pressure-side plate member inner surface 72*a*. In other words, the first communication passage forming surface 83 according to the present embodiment is recessed only from the pressure-side plate member inner surface 72*a*.

As illustrated in FIG. 4, the second drain flow path 77 is formed closer to the leading edge 7*a* than the first drain flow path 75. The second drain flow path 77 is a space formed between the suction-side plate member 71 and the pressure-side plate member 72. As illustrated in FIG. 3, the second drain flow path 77 extends in the blade height direction D1 inside the blade body 7. The second drain flow path 77 penetrates the blade body 7 to make the inner shroud 21 and the outer shroud 22 in communication with each other. As illustrated in FIG. 4, the second drain flow path 77 is formed between the suction-side plate member 71 and the pressure-side plate member 72 by a second drain flow path forming surface 84 formed on each of the suction-side plate member inner surface 71*a* and the pressure-side plate member inner surface 72*a*. The second drain flow path 77 according to the present embodiment is formed by a second drain flow path suction-side forming surface 84*a* formed on the suction-side plate member inner surface 71*a* by bending the suction-side plate member 71 and a second drain flow path pressure-side surface forming surface 84*b* formed on the pressure-side plate member inner surface 72*a* by bending the pressure-side plate member 72. Thus, the second drain flow path forming surface 84 forming the second drain flow path 77 according to the present embodiment includes the second drain flow path suction-side forming surface 84*a* that is a part of the suction-side plate member inner surface 71*a* and the second drain flow path pressure-side forming surface 84*b* that is a part of the pressure-side plate member inner surface 72*a*.

The second suction port 78 opens in the suction-side surface 701. The second suction port 78 extends in the blade height direction D1 and opens in the suction-side surface 701. The second suction port 78 according to the present embodiment is formed only in the suction-side surface 701. The second suction port 78 is formed all across the suction-side surface in the blade height direction D1. The second suction port 78 is formed as a single slit that is long in the blade height direction D1. The second suction port 78 has an elongate rectangular shape extending in blade height direction D1 when the suction-side surface 701 is viewed from the blade thickness direction D3. The second suction port 78 is formed closer to the leading edge 7*a* with respect to the center in the chord direction D2.

A plurality of the second communication passages 79 is formed away from one another in the blade height direction D1 within the blade body 7. The second communication passages 79 make the second suction port 78 and the second drain flow path 77 in communication with each other and independent of each other. The second communication passages 79 according to the present embodiment are through-holes penetrating the suction-side plate member 71. The plurality of second communication passages 79 are formed away from one another and prevented from linking to one another between the second drain flow path 77 and the second suction port 78.

The partition portion 80 partitions off the first drain flow path 75 and the second drain flow path 77 independently of each other inside the blade body 7. The partition portion 80 is a region where the suction-side plate member 71 and the pressure-side plate member 72 are joined between the first drain flow path 75 and the second drain flow path 77. The partition portion 80 segregates the first drain flow path 75 from the second drain flow path 77 all across the corresponding region in the blade height direction D1. The partition portion 80 according to the present embodiment is formed by the joining portions 73 in which the suction-side plate member inner surface 71*a* of the suction-side plate member 71 is joined to the pressure-side plate member inner surface 72*a* of the pressure-side plate member 72.

Now, a method for manufacturing the steam turbine blade (stator blade 2) described above will be described in accordance with a flowchart illustrated in FIG. 6.

Figure 6:
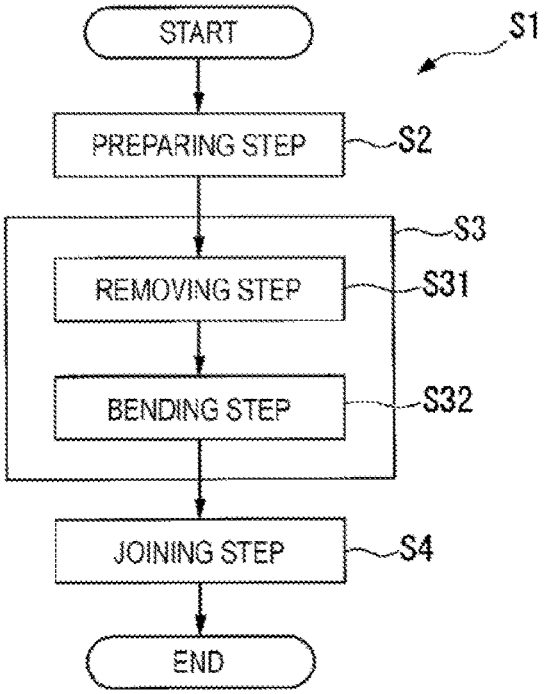
FIG. 6 is a flowchart illustrating a method for manufacturing a steam turbine blade according to an embodiment of the present invention.

As illustrated in FIG. 6, a method S1 for manufacturing a steam turbine blade includes a preparing step S2, a processing step S3, and a joining step S4.

In the method S1 for manufacturing a steam turbine blade, first, the preparing step S2 is performed. In the preparing step S2, the plate-shaped suction-side plate member 71 capable of being formed into a protruding surface-shaped suction-side surface 701 is prepared as the blade surface 70. In the preparing step S2, the plate-shaped pressure-side plate member 72 capable of being formed into a recessed surface-shaped pressure-side surface 702 is prepared as the blade surface 70. The suction-side plate member 71 and the pressure-side plate member 72, prepared in the preparing step S2, each have a plate shape with a rectangular cross section.

In the processing step S3, the suction-side plate member 71 and the pressure-side plate member 72 are processed. In the processing step S3, the first suction port forming surface 81 forming the first suction port 74 is formed on at least one of the suction-side plate member 71 and the pressure-side plate member 72. In the processing step S3, the first drain flow path forming surface 82 forming the first drain flow path 75 and the first communication passage forming surface 83 forming the first communication passages 76 are formed in both the suction-side plate member 71 and the pressure-side plate member 72. In the processing step S3, the suction-side surface 701 is formed on the suction-side plate member 71. In the processing step S3, the pressure-side surface 702 is formed on the pressure-side plate member 72. In the processing step S3, the second drain flow path forming surface 84 forming the second drain flow path 77 is formed on both the suction-side plate member 71 and the pressure-side plate member 72. In the processing step S3, the second suction port 78 and the second communication passages 79 are formed in the suction-side plate member 71.

In the processing step S3 according to the present embodiment, the first suction port suction-side forming surface 81*a* is formed as the first suction port forming surface 81. In the processing step S3, the first drain flow path suction-side forming surface 82*a* and the first drain flow path pressure-side surface forming surface 82*b* are formed as the first drain flow path forming surface 82. In the processing step S3, the first communication passage pressure-side forming surface 83*b* is formed as the first communication passage forming surface 83. In the processing step S3, the second drain flow path suction-side forming surface 84*a* and the second drain flow path pressure-side surface forming surface 84*b* are formed as the second drain flow path forming surface 84.

Additionally, the processing step S3 according to the present embodiment includes a removing step S31 of removing by cutting a part of the suction-side plate member 71 and the pressure-side plate member 72, and a bending step S32 of bending the suction-side plate member 71 and the pressure-side plate member 72.

Figure 7:
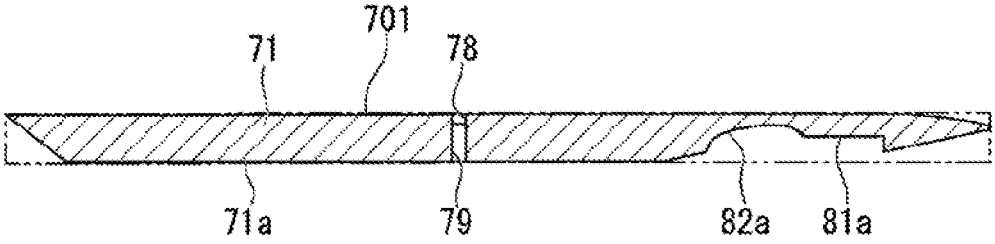
FIG. 7 is a cross-sectional view of a suction-side plate member according to the first embodiment of the present invention.
Figure 8:
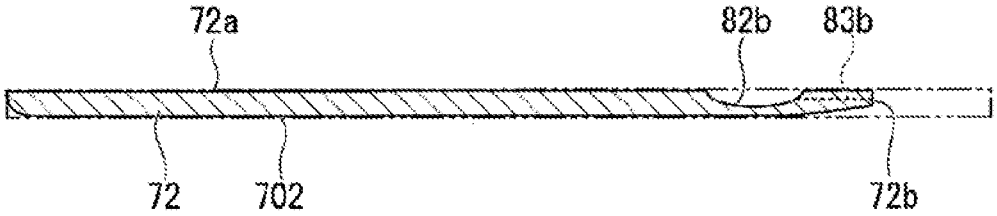
FIG. 8 is a cross-sectional view of a pressure-side plate member according to the first embodiment of the present invention.

In the removing step S31, as illustrated in FIG. 7 and FIG. 8, the suction-side plate member 71 and the pressure-side plate member 72 are partly removed by cutting with grinding processing or cutting processing. In the removing step S31, the first suction port forming surface 81, the first drain flow path forming surface 82, the first communication passage forming surface 83, the second suction port 78, and the second communication passages 79 are formed. In the removing step S31, the first drain flow path forming surface 82 is formed recessed from at least one of the suction-side plate member inner surface 71*a* and the pressure-side plate member inner surface 72*a*. In the removing step S31, the first communication passage forming surface 83 is formed recessed from at least one of the suction-side plate member inner surface 71*a* and the pressure-side plate member inner surface 72*a*.

Specifically, a case of processing the suction-side plate member 71 will be described. As illustrated in FIG. 7, in the removing step S31 according to the present embodiment, unnecessary portions are removed by cutting from the plate-shaped suction-side plate member 71 such that the leading edge 7*a*, the trailing edge 7*b*, and the blade surfaces 70 are formed when the suction-side plate member 71 is combined with the pressure-side plate member 72. At this time, in the removing step S31, a worker cuts the suction-side plate member inner surface 71*a* to form the first suction port suction-side forming surface 81*a* on the suction-side plate member 71 as the first suction port forming surface 81. In the removing step S31, the worker further cuts a part of the first suction port suction-side forming surface 81*a* to form the first drain flow path suction-side forming surface 82*a* on the suction-side plate member 71. In the removing step S31, the suction-side surface 701 is cut to form the second suction port 78. In the removing step S31, the second communication passages 79 penetrating the suction-side plate member 71 are formed to make the second suction port 78 and the second drain flow path forming surface 84 in communication with each other.

Then, a case of processing the pressure-side plate member 72 will be described. As illustrated in FIG. 8, in the removing step S31 according to the present embodiment, unnecessary portions are removed by cutting from the plate shaped pressure-side plate member 72 such that the leading edge 7*a*, the trailing edge 7*b*, and the blade surfaces 70 are formed when the suction-side plate member 71 is combined with the pressure-side plate member 72. At this time, in the removing step S31, the worker cuts the trailing edge 7*b* side of the pressure-side plate member 72 to form a smooth end surface corresponding to the shape of the first suction port suction-side forming surface 81*a* as the first suction port forming surface 81. In the removing step S31, the worker cuts the pressure-side plate member inner surface 72*a* to form the first drain flow path pressure-side forming surface 82*b* on the pressure-side plate member 72. In the removing step S31, the worker cuts the pressure-side plate member inner surface 72*a* to form the first communication passage pressure-side forming surface 83*b* on the pressure-side plate member 72.

In the bending step S32, the suction-side plate member 71 and the pressure-side plate member 72 are curved to form blade surfaces 70 with a predetermined shape on the suction-side plate member 71 and the pressure-side plate member 72. Thus, in the bending step S32, the suction-side plate member 71 and the pressure-side plate member 72 are bent to form the suction-side surface 701 into in a protruding shape and to form the pressure-side surface 702 into a recessed shape. In the bending step S32, the suction-side plate member inner surface 71*a* is bent into a recessed shape to form the second drain flow path suction-side forming surface 84*a* on the suction-side plate member 71 as the second drain flow path forming surface 84. In the bending step S32, the pressure-side plate member inner surface 72*a* is bent in a protruding shape to form the second drain flow path pressure-side forming surface 84*b* on the pressure-side plate member 72 as the second drain flow path forming surface 84.

In the joining step S4, the suction-side plate member 71 and the pressure-side plate member 72 are joined to form the first suction port 74, the first drain flow path 75, the first communication passages 76, and the second drain flow path 77 between the suction-side plate member 71 and the pressure-side plate member 72. Specifically, in the joining step S4, the suction-side plate member 71 and the pressure-side plate member 72 are joined at the end portion of the leading edge 7*a*. Additionally, in the joining step S4, the suction-side plate member 71 and the pressure-side plate member 72 are joined to form the first suction port 74 between the first suction port suction-side forming surface 81*a* and the trailing edge 7*b*-side end surface 72*b* of the pressure-side plate member 72. In the joining step S4, the suction-side plate member 71 and the pressure-side plate member 72 are joined between the second drain flow path forming surface 84 and the first drain flow path forming surface 82. Thus, in the joining step S4, the partition portion 80 partitioning off the second drain flow path 77 and the first drain flow path 75 independently of each other is formed as the joining portion 73. In the joining step S4, the suction-side plate member 71 and the pressure-side plate member 72 are joined by brazing.

In the steam turbine 100 as described above, as illustrated in FIG. 2, the blade body 7 of the stator blade 2 is disposed in the primary flow path C1 through which the steam S flows from the upstream side to the downstream side in the axial direction Da. In the steam S, water droplets are generated as the pressure decreases. Thus, water droplets are likely to be generated particularly in the vicinity of the final stage on the furthest downstream side. Accordingly, the steam S, in a state of containing water droplets, flows through the primary flow path C1. In a case where the main steam S flows in the vicinity of the pressure-side surface 702, the water droplets in the main steam S adhere to the pressure-side surface 702 as fine water droplets due to inertia. Additionally, in a case where the main steam S flows in the vicinity of the suction-side surface 701, the water droplets in the main steam S adhere to the suction-side surface 701 as fine water droplets W due to inertia.

The steam S containing the water droplets collides with the blade body 7, and the water droplets (drain) adhere to the blade surface 70. In particular, as illustrated in FIG. 4, the drain adhering to the pressure-side surface 702 flows from the leading edge 7*a* side toward the trailing edge 7*b* side along the pressure-side surface 702 shaped in a recessed surface, in such a manner as to form a liquid film. The drain adhering to the pressure-side surface 702 flows into the first suction port 74 halfway toward the end portion of the trailing edge 7*b*. In this case, the first drain flow path 75 is in vacuum state because the first drain flow path 75 is connected to the condenser not illustrated via the inner discharge flow path 210 in the inner shroud 21 or the outer discharge flow path 220 in the outer shroud 22. Thus, the drain that has flowed into the first suction port 74 is drawn into the plurality of the first communication passages 76 arranged in juxtaposition and away from one another in the blade height direction D1, flowing into the first drain flow path 75. As illustrated in FIG. 3, the drain having flowed into the first drain flow path 75 flows toward the inner shroud 21 or the outer shroud 22. Thereafter, as illustrated in FIG. 2, the drain is fed to the condenser via the inner discharge flow path 210 in the inner shroud 21 and the outer discharge flow path 220 in the outer shroud 22. Note that, in some of the blade bodies (the blade bodies located furthest downward in the vertical direction) not provided with the first suction port 74 or the second suction port 78, the drain collected in the inner discharge flow path 210 flows through the blade body toward the outer discharge flow path 220 by negative pressure.

Additionally, as illustrated in FIG. 4, the drain adhering to the suction-side surface 701 flows from the leading edge 7*a* side toward the trailing edge 7*b* side along the suction-side surface 701 shaped like a protruding surface. Since the suction-side surface 701 is shaped like a protruding surface, the drain adhering to the suction-side surface 701 typically peels off the suction-side surface 701 before reaching the trailing edge 7*b*-side end portion. However, since the second suction port 78 is formed closer to the leading edge 7*a* with respect to the center in the chord direction D2, the drain adhering to the suction-side surface 701 flows into the second suction port 78 before peeling off the suction-side surface 701. In this case, similarly to the first drain flow path 75, the second drain flow path 77 is connected to the condenser via the inner discharge flow path 210 in the inner shroud 21 and the outer discharge flow path 220 in the outer shroud 22, and is thus in vacuum state. Thus, the drain having flowed into the second suction port 78 is drawn into the second communication passages 79 arranged in juxtaposition and away from one another in the blade height direction D1, flowing into the second drain flow path 77. As illustrated in FIG. 3, the drain having flowed into the second drain flow path 77 flows toward the inner shroud 21 or the outer shroud 22. Thereafter, as illustrated in FIG. 2, the drain merges with drain having flowed from the first drain flow path 75, in the inner discharge flow path 210 in the inner shroud 21 or the outer discharge flow path 220 in the outer shroud 22, and the merged drain is fed to the condenser.

In the stator blade 2 manufactured by the method S1 for manufacturing a steam turbine blade as described above, the plurality of first communication passages 76 are formed independently of one another and away from one another in the blade height direction D1. Thus, even in a case where a pressure difference occurs around the pressure-side surface 702 in the blade height direction D1 in which the first suction port 74 extends, the drain in the first communication passages 76 is inhibited from migrating in the blade height direction D1 in accordance with the pressure difference in the blade height direction D1. As a result, the drain drawn once into the first communication passages 76 through the first suction port 74 located in a high pressure portion is inhibited from flowing out again to the outside from the first suction port 74 located in a low pressure portion. Accordingly, the drain collected once from the first suction port 74 can be inhibited from flowing out to the outside, thus allowing the drain adhering to the blade surface 70 to be efficiently removed.

Additionally, the plurality of the first communication passages 76 are formed independently of one another in the blade height direction D1. Thus, compared to a case where the first communication passage is formed to cover the entire corresponding region in the blade height direction D1, the present configuration allows inhibition of inflow of the steam S flowing around. Accordingly, the drain can be removed with the effect on the flow of the steam S through the primary flow path C1 inhibited.

Additionally, the first suction port 74 is formed in the upper half region of the pressure-side surface 702 in the blade height direction D1. Thus, the drain adhering to the upper half region of the pressure-side surface 702 in the blade height direction D1 can be allowed to flow into the first suction port 74. Accordingly, the drain adhering to the pressure-side surface 702 and flowing toward the trailing edge 7*b* can be accurately collected.

Additionally, the first suction port 74 is formed on the pressure-side surface 702, and the second suction port 78 is formed on the suction-side surface 701. Thus, besides the first suction port 74, a structure for collecting the drain can be independently formed on the suction-side surface 701.

Additionally, the first suction port 74 is formed in the pressure-side surface 702 closer to the trailing edge 7*b* than to the center in the chord direction D2. Thus, the drain adhering to the pressure-side surface 702 and cohesively flowing toward the trailing edge 7*b* in such a manner as to form a liquid film can be collectively allowed to flow into the first suction port 74. As a result, more drain can be collected from the first suction port 74.

In addition, according to the present embodiment, the first communication passages 76 are formed by performing grooving processing on the pressure-side plate member 72 instead of drilling processing and then joining the suction-side plate member 71 and the pressure-side plate member 72. As a result, the first suction port 74 can be formed near the joining portion 73. Thus, the first suction port 74 can be formed with strength maintained in a thin portion such as the trailing edge 7*b*-side end portion. In other words, the first suction port 74 can be formed at a position closer to the end portion of the trailing edge 7*b*, and more drain can be collected from the first suction port 74. Accordingly, the drain adhering to the pressure-side surface 702 can be efficiently collected.

Additionally, the second suction port 78 is formed closer to the leading edge 7*a* with respect to the first suction port 74. Thus, the drain can be collected via the second suction port 78 before the drain adhering to the suction-side surface 701 peels off the suction-side surface 701.

Additionally, the second drain flow path 77 linked to the second suction port 78 and the first drain flow path 75 linked to the first suction port 74 are formed independently of each other inside the blade body 7 by the partition portion 80. Thus, the second suction port 78 and the first suction port 74 can be prevented from communicating with each other inside the blade body 7. Thus, the drain collected via the first suction port 74 through the pressure-side surface 702 having a higher pressure than the suction-side surface 701 can be prevented from flowing through the inside of the blade body 7 out of the second suction port 78 formed in the suction-side surface 701 which is in low pressure. Accordingly, the drain collected once from the first suction port 74 can be inhibited from flowing out to the outside, thus allowing the drain adhering to the blade surface 70 to be efficiently removed.

Additionally, according to the present embodiment, the blade body 7 is formed by joining two plate members of the suction-side plate member 71 and the pressure-side plate member 72. Specifically, in the removing step S31, the first suction port suction-side forming surface 81*a* and the first drain flow path suction-side forming surface 82*a* are formed on the plate-shaped suction-side plate member 71. Additionally, the first drain flow path pressure-side surface forming surface 82*b* and the first communication passage pressure-side forming surface 83*b* are formed on the plate-shaped pressure-side plate member 72. Furthermore, in the bending step S32, the second drain flow path suction-side forming surface 84*a* is formed on the suction-side plate member 71. Additionally, the second drain flow path pressure-side forming surface 84*b* is formed on the plate-shaped pressure-side plate member 72. Then, the suction-side plate member 71 and the pressure-side plate member 72, after processing the bending step S32, are joined and combined together to form the first suction port 74, the first drain flow path 75, the first communication passages 76, and the second drain flow path 77. In this manner, by pre-processing the removing step S31 and the bending step S32 to process the plate-shaped suction-side plate member 71 and pressure-side plate member 72, the processing can be achieved without being affected by the final shape of the blade body 7. Thus, the first suction port suction-side forming surface 81*a*, the first drain flow path suction-side forming surface 82*a*, the first drain flow path pressure-side surface forming surface 82*b*, the first communication passage pressure-side surface forming surface 83*b*, the second drain flow path suction-side forming surface 84*a*, and the second drain flow path pressure-side surface forming surface 84*b* can be formed simply by processing the plate-shaped suction-side plate member 71 and pressure-side plate member 72. As a result, the present method facilitates processing of the first suction port suction-side forming surface 81*a*, the first drain flow path suction-side forming surface 82*a*, the first drain flow path pressure-side surface forming surface 82*b*, the first communication passage pressure-side surface forming surface 83*b*, the second drain flow path suction-side forming surface 84*a*, and the second drain flow path pressure-side surface forming surface 84*b*. Additionally, the present method allows improvement of processing accuracy of the first suction port suction-side forming surface 81*a*, the first drain flow path suction-side forming surface 82*a*, the first drain flow path pressure-side surface forming surface 82*b*, the first communication passage pressure-side surface forming surface 83*b*, the second drain flow path suction-side forming surface 84*a*, and the second drain flow path pressure-side surface forming surface 84*b*.

Furthermore, the first suction port 74, the first drain flow path 75, the first communication passages 76, and the second drain flow path 77 are formed by the first suction port suction-side forming surface 81*a*, the first drain flow path suction-side forming surface 82*a*, the first drain flow path pressure-side surface forming surface 82*b*, the first communication passage pressure-side surface forming surface 83*b*, the second drain flow path suction-side forming surface 84*a*, and the second drain flow path pressure-side surface forming surface 84*b*. As a result, even in a case where the blade body 7 is thin or has a shape difficult to process as in a case where the blade surface 70 is formed by a complex three-dimensional curved surface, the first suction port 74, the first drain flow path 75, the first communication passages 76, and the second drain flow path 77 can be easily formed inside the blade body 7 with inhibiting the effect of processing difficulty due to the final shape of the blade body 7. Accordingly, a space in which the drain is collected can be easily formed inside the blade body 7.

Additionally, by utilizing the surfaces of the two plates to form the first suction port 74, the first drain flow path 75, the first communication passages 76, and the second drain flow path 77, the degree of freedom in manufacturing can be improved for the formation positions, shapes, and the like of the first suction port 74, the second drain flow paths 75, the first communication passages 76, and the second drain flow path 77.

Additionally, the first drain flow path suction-side forming surface 82*a* recessed from the suction-side plate member inner surface 71*a* and the first drain flow path pressure-side surface forming surface 82*b* recessed from the pressure-side plate member inner surface 72*a* are formed as the first drain flow path forming surface 82. Thus, by forming the first drain flow path forming surface 82 recessed from at least one of the suction-side plate member 71 and the pressure-side plate member 72, a larger first drain flow path 75 can be formed without any increase in the plate thicknesses of the suction-side plate member 71 and the pressure-side plate member 72.

Additionally, the first drain flow path forming surface 82 can be formed simply by processing the surface of the plate-shaped suction-side plate member 71 or pressure-side plate member 72, and thus the first drain flow path forming surface 82 can be processed easily. Furthermore, the first drain flow path 75 is formed between the suction-side plate member 71 and the pressure-side plate member 72 by the first drain flow path suction-side forming surface 82*a* and the first drain flow path pressure-side forming surface 82*b*. Accordingly, the first drain flow path 75 can be easily formed inside the blade body 7.

In particular, the present embodiment forms both the first drain flow path suction-side forming surface 82*a* and the first drain flow path pressure-side forming surface 82*b*, and thus allows inhibition of an increase in the recessed depth per plate member when the first drain flow path forming surface 82 is formed, compared to a case where the first drain flow path forming surface 82 is formed on only one of the suction-side plate member 71 and the pressure-side plate member 72. Accordingly, the suction-side plate member 71 and the pressure-side plate member 72 can each be inhibited from having a large plate thickness.

Additionally, the first communication passage pressure-side forming surface 83*b* is formed as a groove recessed from the pressure-side plate member inner surface 72*a*. Thus, the first communication passage forming surface 83 can be formed simply by processing the surface of the plate-shaped pressure-side plate member 72. Accordingly, processing of the first communication passage forming surface 83 is facilitated. Additionally, the first communication passages 76 are formed between the suction-side plate member 71 and the pressure-side plate member 72 by the first communication passage forming surface 83. Thus, the first communication passages 76 can be easily formed inside the blade body 7.

In addition, in the removing step S31, each of the suction-side plate member 71 and the pressure-side plate member 72 is cut to form the first suction port suction-side forming surface 81*a*, the first drain flow path suction-side forming surface 82*a*, the first drain flow path pressure-side surface forming surface 82*b*, the first communication passage pressure-side surface forming surface 83*b*, and the second communication passages 79. Additionally, the second drain flow path forming surface 84 is formed in the bending step S32 at a timing for forming the suction-side surface 701 and the pressure-side surface 702. Thus, new preparation of members other than the suction-side plate member 71 and the pressure-side plate member 72 is not required for formation of the first suction port 74, the first drain flow path 75, the first communication passages 76, the second drain flow path 77, and the second communication passages 79. As a result, the number of components forming the blade body 7 can be reduced, enabling a reduction in the manufacturing costs of the blade body 7.

Additionally, the second drain flow path forming surface 84 can be formed simply by bending processing the plate-shaped suction-side plate member 71 and the pressure-side plate member 72. As a result, processing of the second drain flow path forming surface 84 is facilitated. Additionally, the second drain flow path 77 is formed by the second drain flow path forming surface 84. Thus, even in a case where the blade body 7 is thin or has a final shape difficult to process internally as in a case where the blade surface is formed by a complex three-dimensional curved surface, the second drain flow path 77 can be easily formed inside the blade body.

Additionally, the partition portion 80 making the first drain flow path 75 and the second drain flow path 77 independent of each other is formed by the joining portions 73. Thus, the present configuration eliminates a need for an operation in which the partition portion 80 is formed using another member or cut out in post-processing such as drilling or electrical discharge machining. Accordingly, by pre-processing and joining the two plate members to form the partition portion 80, two spaces in communication with each other in the blade height direction D1 inside the blade body 7 can be easily formed independently of each other even in a case where the blade body 7 has a shape difficult to process. Thus, the first drain flow path 75 and the second drain flow path 77, independent of each other, can be formed inside the blade body 7 with inhibiting the effect of processing difficulty due to the shape of the blade body 7. In other words, the degree of freedom in manufacturing can be improved for the formation positions, shapes, and the like of the first drain flow path 75 and the second drain flow path 77.

Additionally, according to the steam turbine 100 described above, the drain can be efficiently collected by the stator blades 2, and the steam turbine 100 can be efficiently operated.

First Modified Example

Now, a blade body 7A according to a first modified example of the first embodiment will be described with reference to FIG. 9.

Components of the first modified example similar to the corresponding components of the first embodiment are denoted by the same reference signs, and detailed descriptions of these components are omitted. The blade body 7A according to the first modified example differs from the blade body according to the first embodiment in a configuration in which the first communication passage forming surface 83 forming the first communication passage 76 is formed on the suction-side plate member 71.

Figure 9:
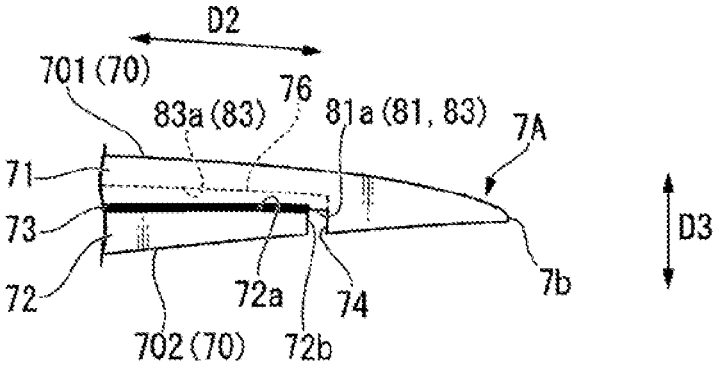
FIG. 9 is a plan view of main parts illustrating the trailing end portion of the stator blade according to a first modified example of the first embodiment of the present invention.

As illustrated in FIG. 9, the first communication passages 76 according to the first modified example are formed by the pressure-side plate member inner surface 72*a* and a first communication passage suction-side forming surface 83*a* recessed in an angular groove shape from a first suction port suction-side surface 81*a* of the suction-side plate member 71. Thus, the first communication passage forming surface 83 forming the first communication passages 76 in the present modified example includes a part of the pressure-side plate member inner surface 72*a* and the first communication passage suction-side forming surface 83*a*. Like formation of the first drain flow path suction-side forming surface 82*a*, formation of the first communication passage suction-side forming surface 83*a* is performed by the worker further cutting a part of the first suction port suction-side forming surface 81*a* in the removing step S31. The first communication passage suction-side forming surface 83*a* is recessed from the first suction port suction-side forming surface 81*a* as a plurality of angular grooves arranged in juxtaposition and away from one another in the blade height direction D1.

The first communication passage suction-side forming surface 83*a* is formed as a groove that is recessed from the first suction port suction-side forming surface 81*a*. As a result, the first communication passage forming surface 83 can be formed simply by processing the surface of the plate-shaped suction-side plate member 71. Accordingly, processing of the first communication passage forming surface 83 is facilitated. Additionally, the first communication passages 76 are formed between the suction-side plate member 71 and the pressure-side plate member 72 by the first communication passage forming surface 83. Thus, the first communication passages 76 can be easily formed inside the blade body 7.

Additionally, as in the case of the first embodiment where the first communication passage forming surface 83 is formed on the pressure-side plate member 72, in the first modified example, a plurality of first communication passages 76 are formed independently of one another. As a result, the drain can be efficiently allowed to flow from the first suction port 74 into the first drain flow path 75.

Second Modified Example

Now, a blade body 7B according to a second modified example of the first embodiment will be described with reference to FIG. 10.

Components of the second modified example similar to the corresponding components of the first embodiment are denoted by the same reference signs and detailed descriptions of these components are omitted. The blade body 7B according to the second modified example differs from the blade body according to the first embodiment in a position where a first suction port 74A is formed.

Figure 10:
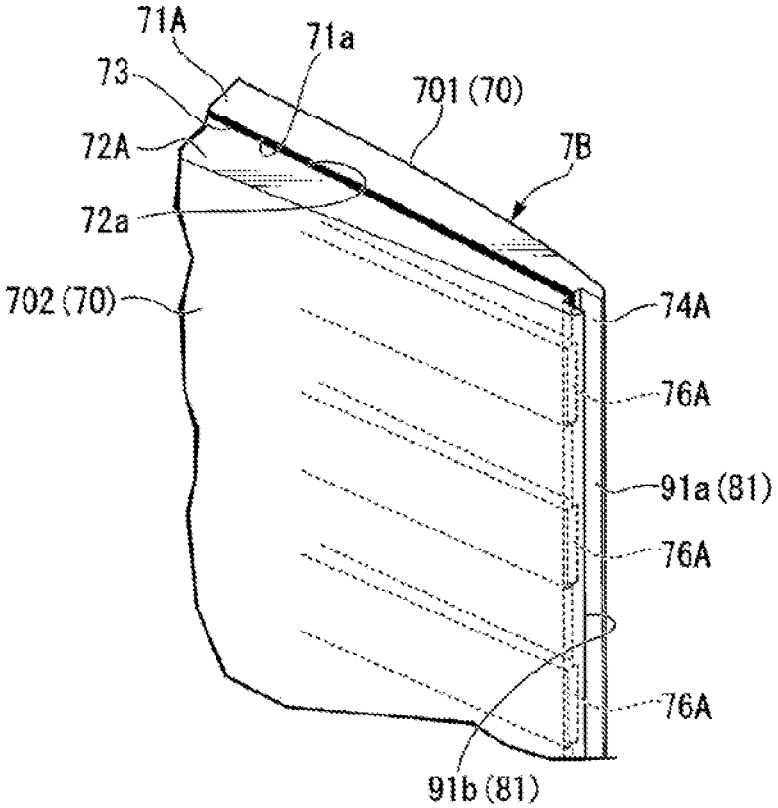
FIG. 10 is a perspective view of main parts illustrating the trailing end portion of the stator blade according to a second modified example of the first embodiment of the present invention.

As illustrated in FIG. 10, the first suction port 74A according to the second modified example is formed at the trailing edge 7*b*-side end portion of the blade surface 70 where the pressure-side surface 702 and the suction-side surface 701 are connected together. In other words, the first suction port 74A is recessed in such a manner as to be formed by cutting the trailing edge 7*b*-side end portion. The first suction port 74A according to the second modified example is formed by both the suction-side surface 701 and the pressure-side surface 702. The first suction port 74A is formed across the trailing edge 7*b*-side end portion in the blade height direction D1. The first suction port 74A is formed as a single angular groove extending in the blade height direction D1. The first suction port 74A is formed by the first suction port forming surface 81 formed on each of a suction-side plate member 71A and a pressure-side plate member 72A. The first suction port 74A according to the second modified example is formed by a first suction port suction-side surface 91*a* recessed from the trailing edge 7*b*-side end surface of the suction-side plate member 71A and the suction-side plate member inner surface 71*a* and a first suction port pressure-side forming surface 91*b* recessed from the trailing edge 7*b*-side end surface of the pressure-side plate member 72A and the pressure-side plate member inner surface 72*a*. In the second modified example, the first suction port forming surface 81 forming the first suction port 74A includes the first suction port suction-side forming surface 91*a* and the first suction port pressure-side forming surface 91*b*.

The first suction port 74A according to the second modified example is formed at the trailing edge 7*b*-side end portion. Thus, drain adhering to the suction-side surface 701 or the pressure-side surface 702 and flowing to the trailing edge 7*b* side can be collected at the furthest downstream end portion, and as a result, more drain can be collected from the first suction port 74A. Accordingly, the drain adhering to the suction-side surface 701 and the pressure-side surface 702 can be efficiently collected.

Third Modified Example

Now, a blade body 7C according to a third modified example of the first embodiment will be described with reference to FIG. 11.

Components according to the third modified example similar to the corresponding components of the first embodiment are denoted by the same reference signs and detailed descriptions of these components are omitted. The blade body 7C according to the third modified example differs from the blade body according to the first embodiment in a configuration in which the second drain flow path is not formed.

Figure 11:
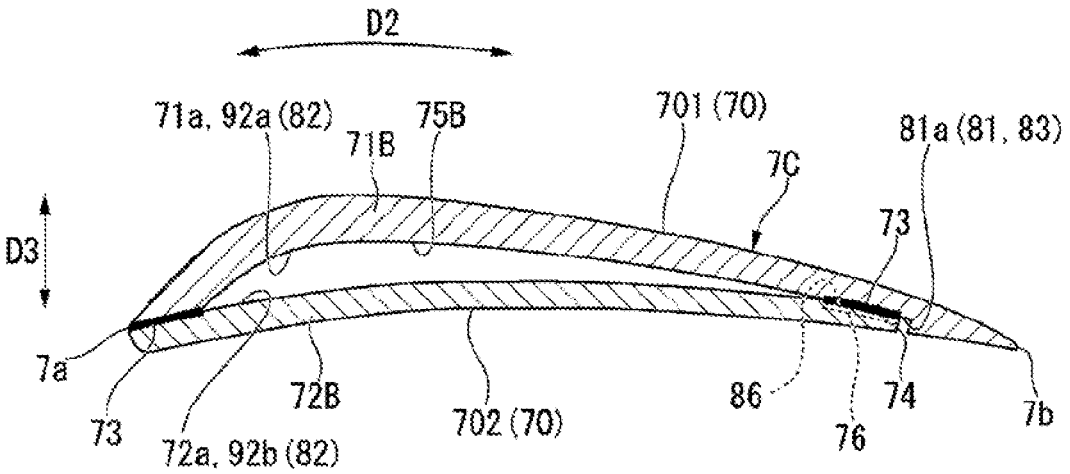
FIG. 11 is a cross-sectional view of the stator blade in a virtual plane orthogonal to the blade height direction according to a third modified example of the first embodiment of the present invention.

In the blade body 7C according to the third modified example, as illustrated in FIG. 11, the second drain flow path, the second suction port, and the second communication passage are not formed. In other words, only a first drain flow path 75B, the first suction port 74, and the first communication passages 76 are formed inside the blade body 7. Since the second drain flow path is not formed, the first drain flow path 75B can be formed simply by bending the suction-side plate member 71B or the pressure-side plate member 72B in the bending processing to form a space inside the blade body 7C. Thus, the curved suction-side plate member inner surface 71*a* itself serves as the first drain flow path suction-side forming surface 92*a*, and the curved pressure-side plate member inner surface 72*a* itself serves as the first drain flow path pressure-side forming surface 92*b*. Accordingly, in the removing step S31, there is no need for cutting the suction-side plate member inner surface 71*a* and the pressure-side plate member inner surface 72*a* to form the first drain flow path forming surface 82 recessed from the suction-side plate member inner surface 71*a* and the pressure-side plate member inner surface 72*a*. Thus, processing costs can be kept low and the manufacturing costs of the blade body 7C can be reduced.

Fourth Modified Example

Now, a blade body 7D according to a fourth modified example of the first embodiment will be described with reference to FIG. 12.

Components according to the fourth modified example similar to the corresponding components of the first embodiment are denoted by the same reference signs and detailed descriptions of these components are omitted. The blade body 7D according to the fourth modified example differs from the blade body according to the first embodiment in that the blade body 7D is formed from a single plate member.

Figure 12:
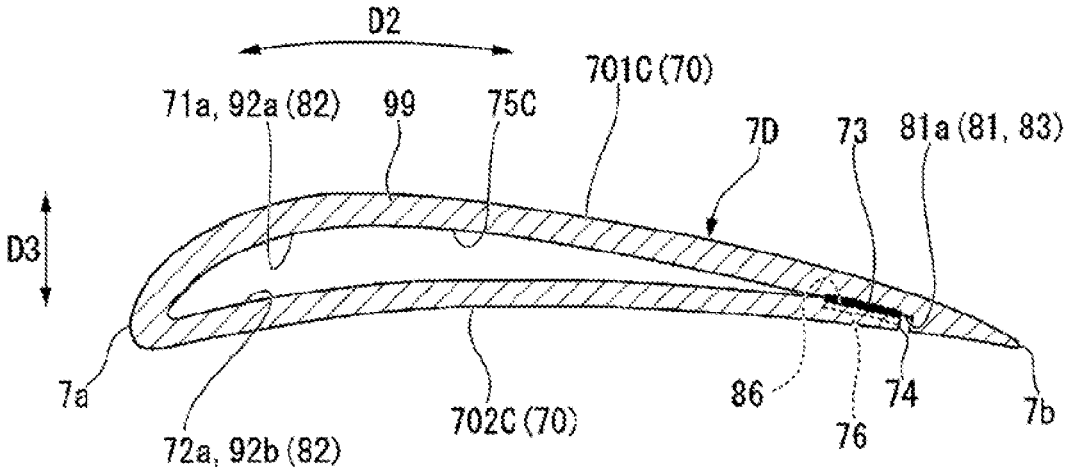
FIG. 12 is a cross-sectional view of the stator blade in a virtual plane orthogonal to the blade height direction according to a fourth modified example of the first embodiment of the present invention.

As illustrated in FIG. 12, the blade body 7D according to the fourth modified example includes a single blade forming plate member 99 and the joining portion 73 as the suction-side plate member 71 and the pressure-side plate member 72. The blade forming plate member 99 is a single plate member shaped like the suction-side plate member 71 and the pressure-side plate member 72 according to the first embodiment linked together. The blade forming plate member 99 is bent to form both a suction-side surface 701C and a pressure-side surface 702C as the blade surfaces 70. The blade forming plate member 99 is curved to form a space inside the blade body 7D. The blade forming plate member 99 is bent to form the leading edge 7*a*. In other words, in the blade body 7D according to the fourth modified example, the joining portion 73 is not formed at the leading edge 7*a*-side end portion. Both end portions of the blade forming plate member 99 are joined together on the trailing edge 7*b* side to form the joining portion 73. In other words, in the blade body 7D according to the fourth modified example, both end portions of the blade forming plate member 99 are joined to form the first suction port 74.

Additionally, as is the case with the third modified example, the blade body 7D according to the fourth modified example is not provided with the second drain flow path 77, the second suction port 78, or the second communication passages 79. In other words, the blade body 7D is internally provided only with the first drain flow path 75C, the first suction port 74, and the first communication passages 76.

When the blade body 7D according to the fourth modified example is manufactured, in the preparing step S2 of the method S1 for manufacturing a steam turbine blade, the suction-side plate member 71 and the pressure-side plate member 72 are prepared as a single blade forming plate member 99. Thereafter, in the bending step S32, the blade forming plate member 99 is bent to form the leading edge 7*a*-side end portion of the blade both 7D. Furthermore, in the joining step S4, the first suction port 74 is formed by joining both end portions of the blade forming plate member 99.

According to the stator blade 2 according to the fourth modified example described above, the blade body 7D can be formed with a reduced number of components. As a result, the manufacturing costs of the blade body 7D can be reduced. Additionally, the stator blade 2 according to the fourth modified example can also obtain the same operational effects as those of the third modified example.

Fifth Modified Example

Now, a blade body 7E according to a fifth modified example of the first embodiment will be described with reference to FIG. 13.

Components according to the fifth modified example similar to the corresponding components of the first embodiment are denoted by the same reference signs and detailed descriptions of these components are omitted. The blade body 7E according to the fifth modified example differs from the blade body according to the first embodiment in that the blade body 7E is formed from a single plate member.

Figure 13:
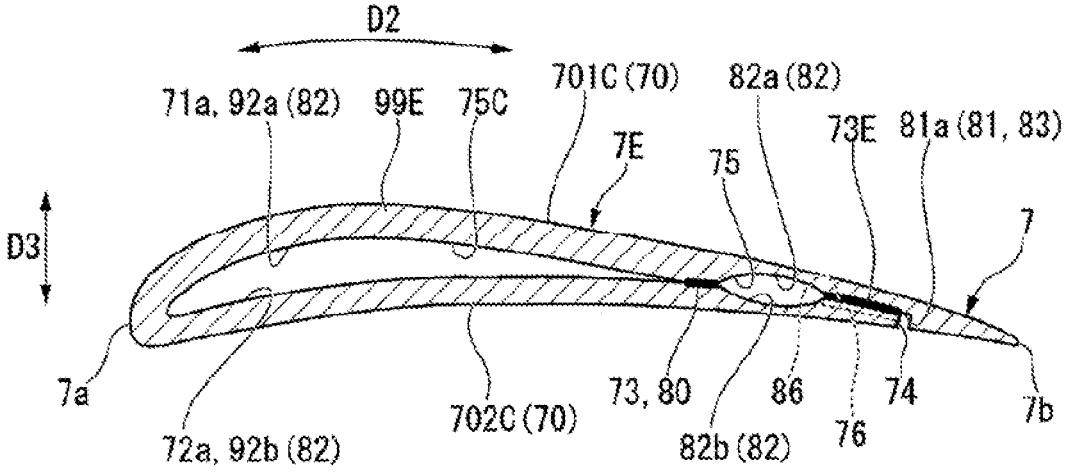
FIG. 13 is a cross-sectional view of the stator blade in a virtual plane orthogonal to the blade height direction according to a fifth modified example of the first embodiment of the present invention.

As illustrated in FIG. 13, the blade body 7E according to the fifth modified example includes a single blade forming plate member 99E and a joining portion 73E as the suction-side plate member 71 and the pressure-side plate member 72. The blade forming plate member 99E is a single plate member shaped like the suction-side plate member 71 and the pressure-side plate member 72 according to the first embodiment linked together. The blade forming plate member 99E is bent to form both the suction-side surface 701C and the pressure-side surface 702C as the blade surfaces 70. The blade forming plate member 99E is curved to form a space inside the blade body 7E. The blade forming plate member 99E is bent to form a leading edge 7*a*. In other words, in the blade body 7E according to the fifth modified example, the joining portion 73E is not formed at the leading edge 7*a*-side end portion. Both end portions of the blade forming plate member 99E are joined on the trailing edge 7*b* side to form the joining portion 73E. In other words, in the blade body 7E according to the fifth modified example, the first suction port 74 is formed by joining both end portions of the blade forming plate member 99E.

When the blade body 7E according to the fifth modified example is manufactured, in the preparing step S2 of the method S1 for manufacturing a steam turbine blade, the suction-side plate member 71 and the pressure-side plate member 72 are prepared as a single blade forming plate member 99E. Thereafter, in the bending step S32, the blade forming plate member 99E is bent to form the leading edge 7*a*-side end portion of the blade body 7E. Furthermore, in the joining step S4, the first suction port 74 is formed by joining both end portions of the blade forming plate member 99E.

According to the stator blade 2 of the fifth modified example described above, the blade body 7E can be formed with a reduced number of components. As a result, the manufacturing costs of the blade body 7E can be reduced.

Second Embodiment

Now, a second embodiment of the steam turbine blade according to the present invention will be described with reference to FIGS. 14 to 16. The stator blade corresponding to the steam turbine blade illustrated in the second embodiment differs from the stator blade according to the first embodiment in that the blade body is a solid structure. Accordingly, in the description of the second embodiment, same components as those of the first embodiment will be described using the same reference signs, and overlapping descriptions are omitted.

Figure 14:
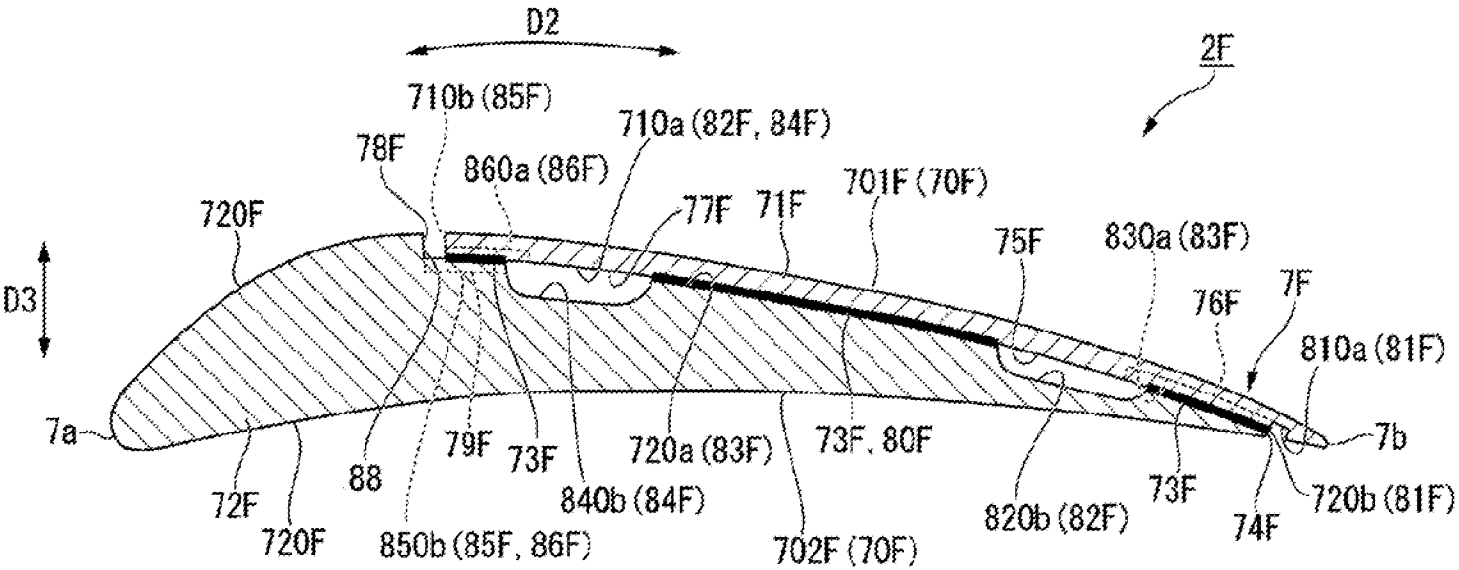
FIG. 14 is a cross-sectional view of a blade body of a stator blade in a virtual plane orthogonal to the blade height direction according to a second embodiment of the present invention.

As illustrated in FIG. 14, the blade body 7F according to the second embodiment includes a suction-side plate member 71F, a pressure-side plate member 72F, and a plurality of joining portions 73F.

The suction-side plate member 71F forms a part of a protruding surface-shaped suction-side surface 701F as a blade surface 70F. The suction-side plate member 71F is a plate member that is thinner and smaller than the suction-side plate member 71 according to the first embodiment. The suction-side plate member 71F is curved along the pressure-side plate member 72F. The suction-side surface 701F is a surface facing outward when the suction-side plate member 71F is joined to the pressure-side plate member 72F. Additionally, a suction-side plate member inner surface 710*a* of the suction-side plate member 71F is a surface facing inward of the blade body 7F when the suction-side plate member 71F is joined to the pressure-side plate member 72F, the surface being located on a side of the pressure-side plate member 72F than the suction-side surface 701F. The suction-side plate member inner surface 710*a* forms a part of the pressure-side surface 702F at the trailing edge 7*b*, and the suction-side plate member 71F according to the second embodiment forms an end portion of the trailing edge 7*b*.

The pressure-side plate member 72F forms the recessed surface-shaped pressure-side surface 702F and a part of the suction-side surface 701F as blade surfaces 70F. The pressure-side plate member 72F has an airfoil-shaped cross section and extends in the blade height direction D1. The pressure-side plate member 72F has a larger thickness in the blade thickness direction D3 than the pressure-side plate member 72 according to the first embodiment. The pressure-side plate member 72F has a thickness similar to that of the final blade body 7F in the blade thickness direction D3. An outer circumferential surface 720F of the pressure-side plate member 72F forms the pressure-side surface 702F and a part of the leading edge 7*a* side of the suction-side surface 701F. The pressure-side plate member 72F includes an accommodating recessed portion 88 formed in a part of the suction-side surface 701F-side outer circumferential surface 720F, and the suction-side plate member 71F can be accommodated in the accommodating recessed portion 88. The accommodating recessed portion 88 is recessed from the suction-side surface 701F-side outer circumferential surface 720F, while not being recessed from the leading edge 7*a*-side outer circumferential surface 720F. Thus, the leading edge 7*a*-side outer circumferential surface 720F of the pressure-side plate member 72F forms a part of the suction-side surface 701F. The pressure-side surface 702F is a part of the outer circumferential surface 720F, and is a surface facing a side where the suction-side plate member 71F is not disposed when the pressure-side plate member 72F is joined to the suction-side plate member 71F. Additionally, a pressure-side plate member inner surface 720*a* of the pressure-side plate member 72F is a surface facing inward of the blade body 7F when the pressure-side plate member 72F is joined to the suction-side plate member 71F, the surface being located on a side of the suction-side plate member 71F than the pressure-side surface 702F.

The joining portions 73F join the suction-side plate member 71F and the pressure-side plate member 72F. The joining portions 73F according to the second embodiment are portions where the suction-side plate member 71F and the pressure-side plate member 72F are joined by brazing, and are formed by solidifying silver solder. The joining portions 73F join the suction-side plate member 71F and the pressure-side plate member 72F without any gap in the blade height direction D1. In the blade body 7F according to the second embodiment, the joining portions 73F join the suction-side plate member inner surface 710*a* and the pressure-side plate member inner surface 720*a*.

Additionally, the blade body 7F according to the second embodiment includes a first suction port 74F, a first drain flow path 75F, first communication passages 76F, a second drain flow path 77F, a second suction port 78F, second communication passages 79F, and a partition portion 80F.

The first suction port 74F according to the second embodiment is formed only in the pressure-side surface 702F. The first suction port 74F is formed in an upper half region of the pressure-side surface 702F in the blade height direction D1. The first suction port 74F is formed as a single long groove extending in the blade height direction D1. The first suction port 74F has an elongate rectangular shape extending in the blade height direction D1 when the pressure-side surface 702F is viewed from the blade thickness direction D3. The first suction port 74F is formed closer to the trailing edge 7*b* with respect to the center in the chord direction D2. The first suction port 74F is formed by a first suction port forming surface 81F formed on the suction-side plate member 71F and the pressure-side plate member 72F. The first suction port 74F according to the present embodiment is formed by a trailing edge 7*b*-side end surface 720*b* of the pressure-side plate member 72F and the first suction port suction-side forming surface 810*a* recessed in an angular groove shape from the suction-side plate member inner surface 710*a* of the suction-side plate member 71F. The first suction port suction-side forming surface 810*a* is formed as a vertically long angular groove extending in the blade height direction D1. Thus, according to the present embodiment, the first suction port forming surface 81F forming the first suction port 74F includes the first suction port suction-side forming surface 810*a* and the trailing edge 7*b*-side end surface 720*b* of the pressure-side plate member 72F.

The first drain flow path 75F is a space formed between the suction-side plate member 71F and the pressure-side plate member 72F. The first drain flow path 75F extends in the blade height direction D1 inside the blade body 7F. The first drain flow path 75F is formed between the suction-side plate member 71F and the pressure-side plate member 72F by a first drain flow path forming surface 82F formed on each of the suction-side plate member inner surface 710*a* and the pressure-side plate member inner surface 720*a*. The first drain flow path 75F according to the second embodiment is recessed from the pressure-side plate member inner surface 720*a*. The first drain flow path 75F is formed by the suction-side plate member inner surface 710*a* and a first drain flow path pressure-side forming surface 820*b* recessed from the pressure-side plate member inner surface 720*a*. The first drain flow path pressure-side forming surface 820*b* according to the second embodiment is recessed from the pressure-side plate member inner surface 720*a* to form a recessed curved surface. Accordingly, the first drain flow path forming surface 82F forming the first drain flow path 75F according to the second embodiment includes a part of the suction-side plate member inner surface 710*a* and the first drain flow path pressure-side forming surface 820*b*.

A plurality of the communication passages 76F are formed away from one another in the blade height direction D1 inside the blade body 7F. The plurality of first communication passages 76F are formed so as not to link to one another in the blade height direction D1 between the first suction port 74F and the first drain flow path 75F. The first communication passages 76F are spaces formed between the suction-side plate member 71F and the pressure-side plate member 72F. The first communication passages 76F are formed between the suction-side plate member 71F and the pressure-side plate member 72F by a first communication passage forming surface 83F formed on each of the suction-side plate member inner surface 710*a* and the pressure-side plate member inner surface 720*a*. The first communication passages 76F are recessed from the suction-side plate member inner surface 710*a*. The first communication passages 76F according to the second embodiment are formed by a first communication passage suction-side forming surface 830*a* recessed in an angular groove shape from the suction-side plate member inner surface 710*a* of the suction-side plate member 71F and the pressure-side plate member inner surface 720*a*. The first communication passage suction-side forming surface 830*a* is a surface providing a plurality of angular grooves formed away from one another in the blade height direction D1. The plurality of first communication passage suction-side forming surface 830*a* are in communication with the first suction port suction-side forming surface 810*a* on the trailing edge 7*b* side. Accordingly, the first communication passage forming surface 83F forming the first communication passages 76F according to the second embodiment includes the first communication passage suction-side forming surface 830*a* and a part of the pressure-side plate member inner surface 720*a*.

The second drain flow path 77F is formed closer to the leading edge 7*a* with respect to the first drain flow path 75F. The second drain flow path 77F is a space formed between the suction-side plate member 71F and the pressure-side plate member 72F. The second drain flow path 77F extends in the blade height direction D1 inside the blade body 7F. The second drain flow path 77F is formed between the suction-side plate member 71F and the pressure-side plate member 72F by a second drain flow path forming surface 84F formed on each of the suction-side plate member inner surface 710*a* and the pressure-side plate member inner surface 720*a*. The second drain flow path 77F according to the second embodiment is recessed from the pressure-side plate member inner surface 720*a*. The second drain flow path 77F is formed by a part of the suction-side plate member inner surface 710*a* and a second drain flow path pressure-side forming surface 840*b* recessed from the pressure-side plate member inner surface 720*a*. Accordingly, the second drain flow path forming surface 84F forming the second drain flow path 77F according to the present embodiment includes a part of the suction-side plate member inner side 710*a* and the second drain flow path pressure-side forming surface 840*b*.

The second suction port 78F according to the second embodiment is formed only in the suction-side surface 701F. The second suction port 78F is formed in an upper half region of the suction-side surface 701. The second suction port 78F is formed as a single long groove extending in the blade height direction D1. The second suction port 78F is formed to have in an elongate rectangular shape extending in the blade height direction D1 when the suction-side surface 701F is viewed from the blade thickness direction D3. The second suction port 78F is formed closer to the leading edge 7*a* with respect to the center in the chord direction D2. The second suction port 78F is formed by a second suction port forming surface 85F formed on the suction-side plate member 71F and the pressure-side plate member 72F. The second suction port 78F according to the present embodiment is formed by a leading edge 7*a*-side end surface 710*b* of the suction-side plate member 71F and a second suction port pressure-side forming surface 850*b* recessed from the pressure-side plate member inner surface 720*a* of the pressure-side plate member 72F. The second suction port pressure-side forming surface 850*b* is a surface providing a plurality of angular grooves formed away from one another in the blade height direction D1. Thus, according to the present embodiment, the second suction port forming surface 85F forming the second suction port 78F includes the leading edge 7*a*-side end surface 710*b* of the suction-side plate member 71F and the second suction pressure-side forming surface 850*b*.

The second communication passages 79F are formed away from one another in the blade height direction D1 inside the blade body 7F. The second communication passages 79F make the second suction port 78F and the second drain flow path 77F in communication with each other and independent of each other. The second communication passages 79F according to the present embodiment are formed between the suction-side plate member 71F and the pressure-side plate member 72F by a second communication passage forming surface 86F formed on each of the suction-side plate member inner surface 710*a* and the pressure-side plate member inner surface 720*a*. The second communication passages 79F are each formed recessed from the suction-side plate member inner surface 710*a* and the pressure-side plate member inner surface 720*a*. The second communication passage forming surface 86F according to the second embodiment is formed by a second communication passage suction-side forming surface 860*a* recessed from the suction-side plate member inner surface 710*a* in an angular groove shape and the second suction port pressure-side forming surface 850*b*. The second communication passage suction-side forming surface 860*a* is a surface providing a plurality of angular grooves formed away from one another in the blade height direction D1. The second communication passage suction-side forming surface 860*a* is formed to be at the same position as that of the second suction port pressure-side forming surface 850*b* in the blade height direction D1. The plurality of second communication passage suction-side forming surfaces 860*a* are in communication with the leading edge 7*a*-side end surface 710*b* of the suction-side plate member 71F on the leading edge 7*a* side. Thus, the second communication passage forming surface 86F forming the second communication passages 79F according to the second embodiment includes the second communication passage suction-side forming surface 860*a* and the second suction port pressure-side forming surface 850*b*.

The partition portion 80F partitions off the first drain flow path 75F and the second drain flow path 77F independently of each other inside the blade body 7F. The partition portion 80F is a region where the suction-side plate member 71F and the pressure-side plate member 72F are joined between the first drain flow path 75F and the second drain flow path 77F. The partition portion 80F segregates the first drain flow path 75F from the second drain flow path 77F all across the corresponding region in the blade height direction D1. The partition portion 80F according to the present embodiment is formed by the joining portion 73F in which the suction-side plate member inner surface 710*a* and the pressure-side plate member inner surface 720*a* are joined.

Now, a method for manufacturing the steam turbine blade (stator blade 2F) according to the second embodiment described above will be described. In the method S1 for manufacturing a steam turbine blade, in the preparing step S2, the plate-shaped suction-side plate member 71F and pressure-side plate member 72F each having a rectangular cross section are prepared.

Figure 15:
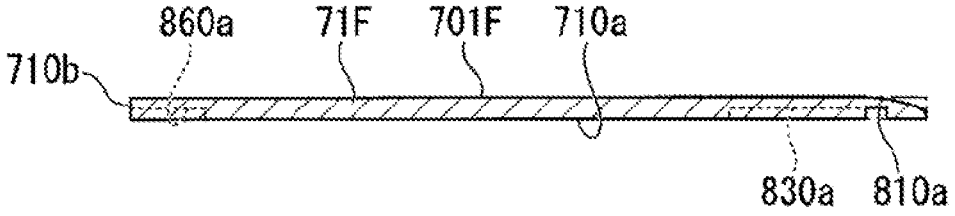
FIG. 15 is a cross-sectional view of a stator-side plate member according to the second embodiment of the present invention.
Figure 16:
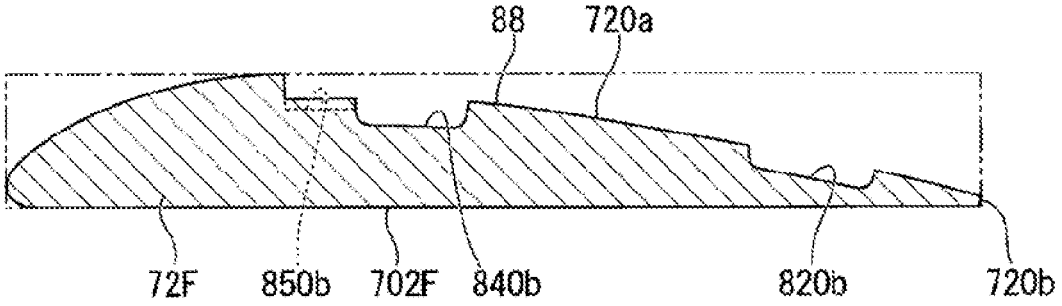
FIG. 16 is a cross-sectional view of a pressure-side plate member according to the second embodiment of the present invention.

Thereafter, in the removing step S31, as illustrated in FIG. 15 and FIG. 16, the suction-side plate member 71F and the pressure-side plate member 72F are partly removed by cutting with grinding processing or cutting processing. The removing step S31 includes forming the first suction port forming surface 81F, the first drain flow path forming surface 82F, the first communication passage forming surface 83F, the second drain flow path forming surface 84F, the second suction port forming surface 85F, and the second communication passage forming surface 86F.

Specifically, a case of processing the suction-side plate member 71F will be described. As illustrated in FIG. 15, in the removing step S31 according to the second embodiment, unnecessary portions are removed by cutting from the plate-shaped suction-side plate member 71F so as to shape the trailing edge 7*b* and a part of the suction-side surface 701F when the suction-side plate member 71F is combined with the pressure-side plate member 72F. At this time, in the removing step S31, the worker cuts the trailing edge 7*b* side of the suction-side plate member inner surface 710*a*, thus forming the first suction port suction-side forming surface 810*a*. In the removing step S31, the worker further cuts a part of the suction-side plate member inner surface 710*a* to make the suction-side plate member inner surface 710*a* in communication with a groove formed by the first suction port suction-side forming surface 810*a*. Thus, the first communication passage suction-side forming surface 830*a* is formed on the suction-side plate member 71F. In the removing step S31, the worker cuts the leading edge 7*a* side of the suction-side plate member inner surface 710*a* to form the second communication passage suction-side forming surface 860*a* as the second communication passage forming surface 86F.

Now, a case of processing the pressure-side plate member 72F will be described. As illustrated in FIG. 16, in the removing step S31 according to the present embodiment, unnecessary portions are removed by cutting from the plate-shaped pressure-side plate member 72F to shape the leading edge 7*a*, a part of the suction-side surface 701F, and the pressure-side surface 702F when the suction-side plate member 71F is combined with the pressure-side plate member 72F. At this time, in the removing step S31, the worker cuts the trailing edge 7*b* side of the pressure-side plate member 72F to form a smooth end surface 720*b* corresponding to the shape of the first suction port suction-side forming surface 810*a*. In the removing step S31, the worker cuts the pressure-side plate member inner surface 720*a* to form the first drain flow path pressure-side forming surface 820*b* on the pressure-side plate member 72F. In the removing step S31, the worker cuts the pressure-side plate member inner surface 720*a* near the middle in the blade chord direction D2, which is located closer to the leading edge 7*a* with respect to the first drain flow path pressure-side forming surface 820*b*. Thus, the second drain flow path pressure-side forming surface 840*b* is formed on the pressure-side plate member 72F. Furthermore, the worker cuts a portion of the pressure-side plate member inner surface 720*a* located closer to the leading edge 7*a* with respect to the second drain flow path pressure-side forming surface 840*b*. Thus, the second suction port pressure-side forming surface 850*b* is formed on the pressure-side plate member 72F.

Thereafter, in the bending step S32, the suction-side plate member 71F is bent to form a part of the suction-side surface 701F on the suction-side plate member 71F. Additionally, the pressure-side plate member 72F is bent to form a part of the suction-side surface 701F and the pressure-side surface 702F on the pressure-side plate member 72F.

In the joining step S4, the suction-side plate member 71F and the pressure-side plate member 72F are joined to form the first suction port 74F, the first drain flow path 75F, the first communication passages 76F, the second drain flow path 77F, the second suction port 78F, and the second communication passages 79F between the suction-side plate member 71F and the pressure-side plate member 72F. Specifically, in the joining step S4, the suction-side plate member 71F and the pressure-side plate member 72F are joined to form the first suction port 74F between the first suction port suction-side forming surface 810*a* and the trailing edge 7*b*-side end surface 720*b* of the pressure-side plate member 72F. Additionally, in the joining step S4, the suction-side plate member 71F and the pressure-side plate member 72F are joined to form the second suction port 78F between the second suction port pressure-side forming surface 850*b* and the leading edge 7*a*-side end surface 710*b* of the suction-side plate member 71F. Furthermore, in the joining step S4, the suction-side plate member inner surface 710*a* and the pressure-side plate member inner surface 720*a* are joined between the second drain flow path forming surface 84F and the first drain flow path forming surface 82F. Thus, in the joining step S4, as the joining portion 73F, the partition portion 80F is formed that partitions off the second drain flow path 77F and the first drain flow path 75F independently of each other.

In the stator blade 2F according to the second embodiment as described above, as is the case with the first embodiment, a plurality of the first communication passages 76F are formed independently of one another. As a result, drain can be efficiently allowed to flow from the first suction port 74F to the first drain flow path 75F. Similarly, a plurality of the second communication passages 79F are formed independently of one another. As a result, the drain can be efficiently allowed to flow from the second suction port 78F to the second drain flow path 77F.

While the above has described embodiments of the present invention in detail with reference to the drawings, each configuration of each embodiment and the combinations thereof are merely examples, and additions, omissions, substitutions, and other changes may be made without deviating from the spirit and scope of the present invention. The present invention is not to be considered as being limited by the foregoing description but is only limited by the scope of the appended claims.

Note that the first suction port 74, 74A and 74F and the second suction port 78 and 78F are not limited to the configuration in which the first suction port 74, 74A and 74F and the second suction port 78 and 78F are formed in a continuous shape in the blade height direction D1. The first suction port 74, 74A and 74F and the second suction port 78 and 78F may be formed as discontinuous slits in the blade height direction D1 as long as the first suction port 74, 74A and 74F and the second suction port 78 and 78F are linked to the plurality of first communication passages 76 and 76F and second communication passages 79 and 79F.

Additionally, the first drain flow path 75, 75B, 75C and 75F, the first suction port 74, 74A and 74F, the second drain flow path 77 and 77E, and the second suction port 78 and 78F may be formed at least in the upper half region in the blade height direction D1. Accordingly, the first drain flow path 75, 75B, 75C and 75F and the second drain flow path 77 and 77E are not limited to the configuration in which the first drain flow path 75, 75B, 75C and 75F and the second drain flow path 77 and 77E are formed all across the corresponding region in the blade height direction of the blade body while penetrating the blade body 7 to communicate with the inner shroud 21 and the outer shroud 22.

Additionally, the first suction port 74, 74A, 74F and the second suction port 78, 78F are not limited to the configuration in which the first suction port 74, 74A, 74F and the second suction port 78, 78F are formed all across the upper half region in the blade height direction D1. The first suction port 74, 74A, 74F and the second suction port 78, 78F may be formed exclusively in a partial region of the blade surface 70, 70F on the leading end side.

Additionally, the first suction port 74, 74A, 74F is not limited to the configuration in which the first suction port 74, 74A, 74F is formed only in the pressure-side surface 702, 702C, 702F. In particular, in a case where the second suction port 78, 78F is not formed as in the third modified example and the fourth modified example, the first suction port 74, 74A, 74F may be formed in the suction-side surface 701, 7010, 701F.

Additionally, the first communication passage forming surface 83, 83F is not limited to the configuration in which the first flow path forming surface 83, 83F is formed recessed from only one of the suction-side plate member inner surface 71*a*, 710*a* of the suction-side plate member 71, 71A, 71B, 71F and the pressure-side plate member inner surface 72*a*, 720*a* of the pressure-side plate member 72, 72A, 72B, 72F as in the embodiments and modified examples. The first flow path forming surface 83, 83F may be formed recessed from both the suction-side plate member inner surface 71*a*, 710*a* of the suction-side plate member 71, 71A, 71B, 71F and the pressure-side plate member inner surface 72*a*, 720*a* of the pressure-side plate member 72, 72A, 72B, 72F as is the case with the first drain flow path forming surface 82 according to the embodiments.

Additionally, the first drain flow path forming surface 82 is not limited to the configuration in which the first drain flow path forming surface 82 is formed recessed from both the suction-side plate member inner surface 71*a* of the suction-side plate member 71, 71A, 71B and the pressure-side plate member inner surface 72*a* of the pressure-side plate member 72, 72A, 72B as in the embodiments. The first drain flow path forming surface 82 may be formed recessed from only one of the suction-side plate member inner surface 71*a*, 710*a* of the suction-side plate member 71, 71A, 71B, 71F and the pressure-side plate member inner surface 72*a*, 720*a* of the pressure-side plate member 72, 72A, 72B, 72F.

Additionally, the second drain flow path forming surface 84 is not limited to the configuration in which the second drain flow path forming surface 84 is formed in the bending step S32 as in the embodiments. Similarly to the first drain flow path forming surface 82, the second drain flow path forming surface 84 may be formed, by cutting, in the removing step S31, so as to be recessed from the suction-side plate member inner surface 71*a* of the suction-side plate member 71 and the pressure-side plate member inner surface 72*a* of the pressure-side plate member 72.

Additionally, the first drain flow path forming surface 82 is not limited to the configuration in which the first drain flow path forming surface 82 is formed in the removing step S31 as in the embodiments. For example, the first drain flow path forming surface 82 may be formed in the bending step S32, similarly to the second drain flow path forming surface 84.

INDUSTRIAL APPLICABILITY

According to the present invention, drain adhering to the blade surface can be efficiently removed.

REFERENCE SIGNS LIST

100 Steam turbine
S Steam
Ac Axial line
Da Axial direction
Dc Circumferential direction
Dr Radial direction
1 Casing
11 Steam inlet
12 Steam outlet
2, 2F Stator blade
3 Rotor
5 Rotor shaft
6 Rotor blade
4 Bearing
41 Journal bearing
42 Thrust bearing
7, 7A, 7B, 7C, 7D, 7E Blade body
D1 Blade height direction
D2 Blade chord direction
D3 Blade thickness direction
70, 70F Blade surface
701, 701C, 701F Suction-side surface
702, 702C, 702F Pressure-side surface
7*a* Leading edge
7*b* Trailing edge
71, 71A, 71B, 71F Suction-side plate member
71*a*, 710*a* Suction-side plate member inner surface
72, 72A, 72B, 72F Pressure-side plate member
72*a*, 720*a* Pressure-side plate member inner surface
73, 73E Joining portion
74, 74A, 74F First suction port
75, 75B, 75C, 75F First drain flow path
751 Contracting portion
76, 76F First communication passage
77, 77E Second drain flow path
78, 78F Second suction port
79, 79F Second communication passage
80, 80F Partition portion
81, 81F First suction port forming surface
81*a*, 91*a*, 810*a* First suction port suction-side forming surface
82, 82F First drain flow path forming surface
82*a*, 92*a*, 820*a* First drain flow path suction-side forming surface
82*b*, 92*b*, 820*b* First drain flow path pressure-side forming surface
83, 83F First communication passage forming surface
83*a*, 830*a* First communication passage suction-side forming surface
83*b*, 830*b* First communication passage pressure-side forming surface
84, 84F Second drain flow path forming surface
84*a* Second drain flow path suction-side forming surface
84*b*, 840*b* Second drain flow path pressure-side forming surface
850*b* Second suction port pressure-side forming surface

860*a* Second communication passage suction-side forming surface
88 Accommodating recessed portion
21 Inner shroud
210 Inner discharge flow path
22 Outer shroud
220 Outer discharge flow path
C1 Primary flow path
S1 Method for producing steam turbine blade
S2 Preparing step
S3 Processing step
S31 Removing step
S32 Bending, step
S4 Joining step
91*b* First suction port pressure-side forming surface
99 Blade forming plate member

The invention claimed is:

1. A steam turbine blade comprising:

a blade body comprising blade surfaces extending in a blade height direction, wherein the blade body comprises:

a first suction port extending in the blade height direction, the first suction port being formed as a single groove that opens to the blade surface;

a first drain flow path internally extending in the blade height direction; and a plurality of first communication passages internally provided away from one another in the blade height direction and independently of one another and making the first suction port and the first drain flow path in communication with each other, wherein first ends of each of the plurality of first communication passages are connected to the first drain flow path, and second ends of each of the plurality of first communication passages are connected to the first suction port, wherein the blade body comprises:

a suction-side plate member forming a protruding surface-shaped suction-side surface as the blade surface;

a pressure-side plate member forming a recessed surface-shaped pressure-side surface as the blade surface; and a plurality of joining portions joining the suction-side plate member and the pressure-side plate member, wherein the suction-side plate member includes a first suction port suction-side forming surface that is recessed from a suction-side plate member inner surface, and wherein the first suction port is configured of at least the first suction port suction-side forming surface and the pressure-side plate member.

2. The steam turbine blade according to claim 1, wherein the first suction port is formed in a recessed surface-shaped pressure-side surface of the blade surface.

3. The steam turbine blade according to claim 1, wherein the first suction port is formed at a trailing edge-side end portion of the blade surface where the recessed surface-shaped pressure-side surface and a protruding surface-shaped suction-side surface are connected.

4. The steam turbine blade according to claim 1, wherein the first suction port is formed in an upper half region of the blade surface in the blade height direction.

5. The steam turbine blade according to claim 1, wherein the blade body comprises:

a second drain flow path internally extending in the blade height direction and formed closer to a leading edge of the blade body with respect to the first drain flow path;

a second suction port opening in the protruding surface-shaped suction-side surface;

a second communication passage making the second suction port and the second drain flow path in communication with each other; and a partition portion partitioning off the second drain flow path and the first drain flow path independently of each other inside the blade body, and wherein the partition portion is formed by welding.

6. The steam turbine blade according to claim 5, wherein one of the plurality of joining portions forms the partition portion.

7. The steam turbine blade according to claim 1, wherein the first drain flow path is formed between the suction-side plate member and the pressure-side plate member by a first drain flow path forming surface formed on each of a suction-side plate member inner surface located closer to a side of the pressure-side plate member than the suction-side surface in the suction-side plate member and a pressure-side plate member inner surface located closer to a side of the suction-side plate member than the pressure-side surface in the pressure-side plate member, and the first drain flow path forming surface is formed recessed from at least one of the suction-side plate member inner surface and the pressure-side plate member inner surface.

8. The steam turbine blade according to claim 1, wherein each of the plurality of the first communication passages is formed between the suction-side plate member and the pressure-side plate member by a first communication passage forming surface formed on each of a suction-side plate member inner surface located closer to a side of the pressure-side plate member than the suction-side surface in the suction-side plate member and a pressure-side plate member inner surface located closer to a side of the suction-side plate member than the pressure-side surface in the pressure-side plate member, and the first communication passage forming surface is formed recessed from at least one of the suction-side plate member inner surface and the pressure-side plate member inner surface.

9. A steam turbine comprising:

a rotor shaft configured to rotate around an axial line; and the steam turbine blade according to claim 1 disposed surrounding the rotor shaft.

10. The steam turbine blade according to claim 1, comprising:

the blade body comprising blade surfaces extending in a blade height direction, wherein the blade body comprises:

a suction-side plate member forming a protruding surface-shaped suction-side surface as the blade surface;

a pressure-side plate member forming a recessed surface-shaped pressure-side surface as the blade surface;

a plurality of joining portions joining the suction-side plate member and the pressure-side plate member;

the first drain flow path extending in the blade height direction between the suction-side plate member and the pressure-side plate member;

a second drain flow path extending in the blade height direction between the suction-side plate member and the pressure-side plate member and formed closer to the leading edge of the blade body than the first drain flow path;

the first suction port and a second suction port opening in the blade surface;

a first communication passage making the first suction port and the first drain flow path in communication with each other;

a second communication passage making the second suction port and the second drain flow path in communication with each other; and a partition portion partitioning off the second drain flow path and the first drain flow path independently of each other inside the blade body, and one of the plurality of joining portions forms the partition portion by the joining, wherein the partition portion is formed by welding.

11. A method for manufacturing a steam turbine blade comprising a first suction port extending in a blade height direction, the first suction port being formed as a single groove that opens to a blade surface of a blade body, the blade body includes the blade surface extending in the blade height direction, a first drain flow path extending in the blade height direction inside the blade body, and a plurality of first communication passages provided away from one another in the blade height direction inside the blade body and independently of one another and making the first suction port and the first drain flow path in communication with each other, the method comprising:

processing a plate-shaped suction-side plate member capable of being formed into a protruding surface-shaped suction-side surface as the blade surface and a plate-shaped pressure-side plate member capable of being formed into a recessed surface-shaped pressure-side surface as the blade surface; and joining the suction-side plate member and the pressure-side plate member to form the first drain flow path and the plurality of first communication passages between the suction-side plate member and the pressure-side plate member, wherein in the processing, a first suction port forming surface forming the first suction port is formed on at least one of the suction-side plate member and the pressure-side plate member, a first drain flow path forming surface forming the first drain flow path, and a first communication passage forming surface forming the first communication passage is formed on both the suction-side plate member and the pressure-side plate member, the suction-side surface is formed on the suction-side plate member, and the pressure-side surface is formed on the pressure-side plate member, wherein the processing comprises removing by cutting a part of the suction-side plate member and the pressure-side plate member; and bending the suction-side plate member and the pressure-side plate member, in the removing, the first suction port forming surface, the first drain flow path forming surface, and the first communication passage forming surface are formed, and in the bending, the suction-side surface and the pressure-side surface are formed, wherein the first suction port is configured of at least the first suction port suction-side forming surface and the pressure-side plate member.

12. The method for manufacturing a steam turbine blade according to claim 11, wherein in the removing, when the suction-side plate member and the pressure-side plate member are joined, the first drain flow path forming surface is formed recessed from at least one of a suction-side plate member inner surface located closer to a side of the pressure-side plate member than the suction-side surface in the suction-side plate member and a pressure-side plate member inner surface located closer to a side of the suction-side plate member than the pressure-side surface in the pressure-side plate member.

13. The method for manufacturing a steam turbine blade according to claim 11, wherein in the removing, when the suction-side plate member and the pressure-side plate member are joined, the first communication passage forming surface is formed recessed from at least one of a suction-side plate member inner surface located closer to a side of the pressure-side plate member than the suction-side surface in the suction-side plate member and a pressure-side plate member inner surface located closer to a side of the suction-side plate member than the pressure-side surface in the pressure-side surface.

14. The method for manufacturing a steam turbine blade according to claim 11, wherein in the removing, as the first suction port forming surface, when the suction-side plate member is joined to the pressure-side plate member, a first suction port suction-side forming surface is formed, which is recessed from a suction-side plate member inner surface located closer to a side of the pressure-side plate member than the suction-side surface, and in the joining, the suction-side plate member and the pressure-side plate member are joined to form the first suction port between the first suction port suction-side forming surface and a trailing edge-side end surface of the pressure-side plate member.

15. The method for manufacturing a steam turbine blade according to claim 11, wherein in the processing, the suction-side plate member and the pressure-side plate member are prepared in a single blade forming plate member, and in the bending, the blade forming plate member is bent to form the suction-side surface and the pressure-side surface and to form a leading edge of the blade body.

16. The method for manufacturing a steam turbine blade according to claim 11, wherein in the bending, a second drain flow path is formed of a second drain flow path forming surface, wherein a second drain flow path suction-side forming surface is formed on the suction-side plate member inner surface by bending the suction-side plate member, wherein a second drain flow path pressure-side surface forming surface is formed on the pressure-side plate member inner surface by bending the pressure-side plate member, wherein the second drain flow path forming surface is formed of the second drain flow path suction-side forming surface and the second drain flow path pressure-side surface forming surface, and in the removing, a second communication passage is formed that penetrates the suction-side plate member to make the suction-side surface and the second drain flow path forming surface of the suction-side plate member in communication with each other.

17. The method for manufacturing a steam turbine blade according to claim 16, wherein in the joining, the suction-side plate member and the pressure-side plate member are joined between the second drain flow path forming surface and the first drain flow path forming surface to form a partition portion partitioning off the second drain flow path and the first drain flow path independently of each other, and wherein the partition portion is formed by welding.

18. The method for manufacturing a steam turbine blade according to claim 11, wherein, in the joining, the suction-side plate member and the pressure-side plate member are joined between the second drain flow path forming surface and the first drain flow path forming surface to form a partition portion partitioning off the second drain flow path and the first drain flow path independently of each other, and wherein the partition portion is formed by welding.

* * * * *